US010612510B2

(12) United States Patent
Miyake et al.

(10) Patent No.: US 10,612,510 B2
(45) Date of Patent: Apr. 7, 2020

(54) IGNITION APPARATUS

(71) Applicant: DENSO CORPORATION, Kariya, Aichi-pref. (JP)

(72) Inventors: Keiko Miyake, Kariya (JP); Shunichi Takeda, Kariya (JP); Kanechiyo Terada, Kariya (JP); Tetsuya Miwa, Kariya (JP)

(73) Assignee: DENSO CORPORATION, Kariya (JP)

( * ) Notice: Subject to any disclaimer, the term of this patent is extended or adjusted under 35 U.S.C. 154(b) by 0 days.

(21) Appl. No.: 16/166,542

(22) Filed: Oct. 22, 2018

(65) Prior Publication Data

US 2019/0120198 A1 Apr. 25, 2019

(30) Foreign Application Priority Data

Oct. 20, 2017 (JP) ..... 2017-2035512

(51) Int. Cl.

| | |
|---|---|
| ***F02P 15/08*** | (2006.01) |
| ***F02P 5/15*** | (2006.01) |
| ***F02P 3/04*** | (2006.01) |
| ***F02P 3/05*** | (2006.01) |
| ***F02P 15/10*** | (2006.01) |

(52) U.S. Cl.

CPC ..... *F02P 5/1506* (2013.01); *F02P 3/0442* (2013.01); *F02P 3/05* (2013.01); *F02P 15/10* (2013.01); *F02D 2200/021* (2013.01); *F02D 2200/0611* (2013.01); *F02D 2200/101* (2013.01)

(58) Field of Classification Search

CPC ..... F02P 5/1506; F02P 5/1502; F02P 15/10; F02P 3/05; F02P 3/0442; F02P 9/002; F02D 2200/101; F02D 2200/0611; F02D 2200/021

USPC ..... 123/605, 618, 620, 621, 623, 636

See application file for complete search history.

(56) References Cited

U.S. PATENT DOCUMENTS

| | | | | |
|---|---|---|---|---|
| 5,886,476 A * | 3/1999 | Skinner | F02P 9/007 | 123/621 |
| 7,681,562 B2 * | 3/2010 | Boerjes | F02P 3/053 | 123/595 |
| 2005/0000502 A1 * | 1/2005 | Waters | F02P 3/0453 | 123/620 |

(Continued)

FOREIGN PATENT DOCUMENTS

WO 2017/060935 4/2017

*Primary Examiner* — Hai H Huynh

(74) *Attorney, Agent, or Firm* — Nixon & Vanderhye P.C.

(57) ABSTRACT

In an ignition apparatus, a controller outputs a discharge start signal instructing a start of a discharge in the spark plug, and a discharge control signal instructing control of a discharge current in the spark plug after the start of the discharge. A signal line connects between the controller and a control circuit. The discharge start signal and the discharge control signal are transferred from the controller to the control circuit via the signal line. The controller modulates, based on the plural command values, the discharge control signal such that the modulated discharge control signal includes information representing the plural command values and change timings for the respective command values. The control circuit controls, based on the discharge start signal and the modified discharge control signal, the energization circuit to thereby adjust the discharge current to each of the command values at a corresponding one of the change timings.

16 Claims, 12 Drawing Sheets

(56) References Cited

U.S. PATENT DOCUMENTS

| | | | | |
|---|---|---|---|---|
| 2007/0181110 | A1* | 8/2007 | Toriyama | F02P 3/0552<br>123/637 |
| 2016/0061177 | A1 | 3/2016 | Ishitani et al. | |
| 2016/0084215 | A1* | 3/2016 | Kondou | F02P 3/0435<br>123/620 |
| 2016/0102648 | A1* | 4/2016 | Nakayama | F02P 9/002<br>123/604 |
| 2016/0305392 | A1 | 10/2016 | Nakamura et al. | |
| 2017/0122281 | A1 | 5/2017 | Imanaka et al. | |
| 2017/0342955 | A1 | 11/2017 | Ishitani et al. | |

* cited by examiner

IGNITION APPARATUS

CROSS REFERENCE TO RELATED APPLICATIONS

This application is based on and claims the benefit of priority from Japanese Patent Application 2017-203512 filed on Oct. 20, 2017, the disclosure of which is incorporated in its entirety herein by reference.

TECHNICAL FIELD

The present disclosure relates to ignition apparatuses for controlling a discharge current flowing through a part of a spark plug.

BACKGROUND

For example, Japanese Patent Application Publication No. 2016-205148 discloses a conventional ignition apparatus. A control circuit of the conventional ignition apparatus sends, to an ignition device, a discharge start signal indicative of an energization timing and de-energization timing to a primary coil.

In addition, the control circuit sends, to the ignition device, a discharge stop signal indicative of a stop timing of control of the discharge current carried out after the occurrence of a discharge in the spark plug.

The control circuit is configured to variably set a delay time of an input timing of the discharge stop signal to the ignition device relative to an input timing of the discharge start signal to the ignition device to thereby control a value of the discharge current based on the delay time.

When resetting the value of the discharge current after the value of the discharge current has been set, the control circuit reenters the discharge stop signal to the ignition device while the discharge start signal is in an on state to thereby update the delay time. This enables the control circuit to control the value of the discharge current without an increase of communication lines between the control circuit and the ignition device.

SUMMARY

The control circuit of the conventional ignition apparatus set forth above is configured to control the value of the discharge current to thereby maintain the discharge current for the duration of the discharge start signal within a predetermined period from a falling edge of the discharge start signal to a falling edge of the discharge stop signal.

If the control circuit causes the previous discharge stop signal to fall and thereafter reenters the delay time after the occurrence of the falling edge of the discharge start signal, control of the discharge current is terminated in response to the falling edge of the discharge stop signal.

For this reason, the control circuit of the ignition apparatus may result in a difficulty of changing the value of the discharge current after the start of controlling the discharge current. There may be therefore room for improvement of the conventional ignition control system.

A first aspect of the present disclosure therefore seeks to provide ignition apparatuses, each of which address the above problem.

Specifically, a second aspect of the present disclosure seeks to provide such an ignition apparatus, which is capable of changing the value of a discharge current after start of controlling the discharge current without an increase of additional signal lines.

A first exemplary aspect of the present disclosure is an ignition apparatus for controlling a discharge current in a spark plug. The ignition apparatus includes an ignition coil including a primary coil and a secondary coil connected to the spark plug, and an energization circuit configured to change an energization state of the primary coil.

The ignition apparatus includes a controller configured to output a discharge start signal instructing a start of a discharge in the spark plug, and a discharge control signal instructing control of a discharge current in the spark plug after the start of the discharge. The ignition apparatus includes a control circuit, and a signal line connecting between the controller and the control circuit. The discharge start signal and the discharge control signal are transferred from the controller to the control circuit via the signal line.

The controller is configured to modulate, based on plural command values, the discharge control signal such that the modulated discharge control signal includes information representing the plural command values and change timings for the respective command values.

The control circuit is configured to control, based on the discharge start signal and the modified discharge control signal, the energization circuit to thereby adjust the discharge current to each of the command values at a corresponding one of the change timings.

The energization circuit of the ignition apparatus changes the energization state of the primary coil to thereby enable a high voltage to be induced in the secondary coil. This enables a discharge in the spark plug to be started and/or control of a discharge current after the start of the discharge to be carried out.

From the controller, a discharge start signal instructing a start of a discharge in the spark plug, and a discharge control signal instructing control of a discharge current in the spark plug after the start of the discharge are output to the control circuit via the signal line connecting between the controller and the control circuit. A single signal line or plural signal lines can be used as the signal line.

In particular, the controller is configured to modulate, based on the plural command values, the discharge control signal such that the modulated discharge control signal includes information representing the plural command values and change timings for the respective command values. The control circuit is configured to control, based on the discharge start signal and the modified discharge control signal, the energization circuit to thereby adjust the discharge current to each of the command values at a corresponding one of the change timings.

That is, because the modulated discharge control signal, which includes information representing the plural command values and change timings for the respective command values, is transferred from the controller to the control circuit separately from the discharge start signal transferred from the controller to the control circuit, the control circuit makes it possible to adjust the discharge current to each of the command values at the corresponding one of the change timings after start of controlling the discharge current.

In a second exemplary aspect of the present disclosure, the controller is configured to modulate, based on the plural command values, the discharge control signal such that the modulated discharge control signal includes, as the information, plural pulses, at least one of a signal level and a width of each of the pulses being set depending on a corresponding one of the command values.

This therefore enables the control circuit to obtain, from the at least one of the signal level and width of each of the pulses, the corresponding one of the command values and the corresponding one of the change timings.

In a third exemplary aspect of the present disclosure, the controller is configured to output the modulated discharge control signal after completion of the output of the discharge start signal to the control circuit, so that each of the change timings is set after the completion of the output of the discharge start signal.

This enables adjustment of the discharge current to be carried out after control of the discharge current.

In a fourth exemplary aspect of the present disclosure, the controller is configured to modulate, based on the plural command values, the discharge control signal such that the modulated discharge control signal includes plural rising and/or falling timings, each of the rising and/or falling timings representing a corresponding one of the change timings.

This enables a smaller amount of information indicative of each of the change timings for the respective command values to be accurately transferred to the control circuit in real time.

In a fifth exemplary aspect of the present disclosure, the change timings are continuous change timings, and the controller is configured to modulate, based on the plural command values, the discharge control signal such that the modulated discharge control signal includes continuously changed signal levels based on the continuous change timings. The continuously changed signal levels enable the continuous change timings of the command values to be obtained.

This therefore enables the change timings of the command values to be flexibly instructed to the control circuit in real time.

In a sixth exemplary aspect of the present disclosure, the signal line includes a first signal line and a second signal line, and the controller is configured to output the discharge start signal to the control circuit via the first signal line. This enables a usual signal line to be used as the first signal line.

In a seventh exemplary aspect of the present disclosure, the controller is configured to (1) Output the modulated discharge control signal to the control circuit via the second signal line (2) Modulate, based on the plural command values, a part of the discharge control signal such that the modulated part of the discharge control signal includes, as the information, the plural pulses, at least one of the signal level and the width of each of the pulses being set depending on a corresponding one of the command values (3) Output the modulated part of the discharge control signal to the control circuit while outputting the discharge start signal to the control circuit This makes it possible to transfer the plural command values to the control circuit via the second signal line while outputting the discharge start signal to the control circuit via the first signal line.

In an eighth exemplary aspect of the present disclosure, the controller is configured to set the discharge start signal to one of binary logical high and low levels when outputting the discharge start signal, and set the discharge start signal to the other of the binary logical high and low levels when the output of the discharge start signal is completed.

The controller is configured to modulate, based on the plural command values, a first part of the discharge control signal such that the first modulated part of the discharge control signal includes, as the information, the plural pulses, at least one of the signal level and the width of each of the pulses being set depending on a corresponding one of the command values.

The controller is configured to modulate, based on the change timings for the respective plural command values, a second part of the discharge control signal such that the second modulated part of the discharge signal includes the change timings for the respective command values. The controller is configured to output the first modulated part of the discharge control signal to the control circuit while outputting the discharge start signal to the control circuit, and output the second modulated part of the discharge control signal to the control circuit after completion of the output of the discharge start signal.

The control circuit is configured to execute a first logical AND between the discharge start signal and the first modulated part of the discharge control signal to thereby extract the plural command values, and execute a second logical AND between an inversion of the discharge start signal and the second modulated part of the discharge control signal to thereby extract the change timings.

As described above, the discharge start signal is set to one of the binary logical high and low levels when being outputted, and is set to the other of the binary logical high and low levels when the output of the discharge start signal is completed. In addition, the first modulated part of the discharge control signal is output to the control circuit while the discharge start signal is being outputted, and the second modulated part of the discharge control signal is output to the control circuit after completion of the discharge start signal to the control circuit.

Let us assume that the first part of the discharge start signal is the high level, and the inversion of the first part of the discharge start signal is the low level. In contrast, after completion of the output of the discharge start signal to the control circuit, the second part of the discharge start signal is the low level, and the inversion of the discharge start signal is the high level.

For this reason, during output of the discharge start signal to the control circuit, the discharge start signal is the high level, and the inversion of the discharge start signal is the low level. In contrast, after completion of the output of the discharge start signal to the control circuit, the discharge start signal is the low level, and the inversion of the discharge start signal is the high level.

This therefore enables the plural command values based on the first logical AND between the discharge start signal and the first modulated part of the discharge control signal to be easily distinguished from the change timings based on the second logical AND between the inversion of the discharge start signal and the second modulated part of the discharge control signal.

In a ninth exemplary aspect of the present disclosure, the controller is configured to modulate, based on the plural command values, the discharge control signal such that the modulated discharge control signal includes (1) A command value setting signal including the width of each of the pulses being set depending on the corresponding one of the command values, each of the pulses in the command value setting signal having a first signal level (2) A command value switching signal including pulses whose signal levels represent the change timings of the respective command values The signal level of each of the pulses included in the command value setting signal is different from the signal level of each of the pulses included in the command value switching signal. Each of the pulses in the command value switching signal has a second signal level. One of the first and second signal levels is higher than a threshold signal level, and the other of the first and second signal levels is lower than the threshold signal level. The control circuit is configured to distinguish one of the command value setting signal and the command value switching signal from the other thereof in accordance with comparison between the threshold signal level and each of the first and second signal levels.

In a tenth exemplary aspect of the present disclosure, the plural command values include at least a first command value and a second command value. The plural pulses include at least a first pulse and a second pulse corresponding to the at least first command value and second command value.

At that time, the controller is configured to (1) Output the modulated discharge control signal to the control circuit via the second signal line (2) Modulate a first part of the discharge control signal such that the modulated first part of the discharge control signal includes, as the information, the first pulse, at least one of the signal level and the width of the first pulse being set depending on the first command value (3) Modulate a second part of the discharge control signal such that the modulated second part of the discharge control signal includes, as the information, the second pulse, at least one of the signal level and the width of the second pulse being set depending on the second command value (4) Output the modulated first part of the discharge control signal to the control circuit while outputting the discharge start signal to the control circuit (5) Output the modulated second part of the discharge control signal to the control circuit after completion of the output of the discharge start signal This makes it possible to instruct the control circuit about the second command value after the start of the discharge in the spark plug. This therefore enables the second command value for the discharge current to be instructed in accordance with the combustion state of the air-fuel mixture.

In an eleventh exemplary aspect of the present disclosure, the controller is configured to output the modulated discharge control signal after completion of the output of the discharge start signal to the control circuit, so that each of the change timings is set after the completion of the output of the discharge start signal.

The control circuit is configured to adjust, based on the discharge control signal, the discharge current to each of the command values at a corresponding one of the change timings.

This makes it possible to cause plural command values to be included in the modulated discharge control signal after completion of the output of the discharge start signal. That is, the previous command value for the discharge current is updated to a new command value at a corresponding change timing determined based on the modulated discharge control signal after the start of the discharge.

In a twelfth exemplary aspect of the present disclosure, the signal line includes a single signal line connecting between the controller and the control circuit, the discharge start signal and the discharge control signal being transferred from the controller to the control circuit via the single signal line. This makes it possible to minimize the number of signal lines through which the discharge start signal and the discharge control signal are transferred. In other words, even if the ignition apparatus has the single signal line between the controller and the control circuit, it is possible to change the discharge current after the start of controlling the discharge current.

In a thirteenth exemplary aspect of the present disclosure, it is assumed that the number of the plural command values is referred to as a command-value number, and the number of the change timings is referred to as a change-timing number.

In this assumption, the control circuit is configured to, upon determining that one of the command-value number and the change-timing number is smaller than the other thereof, adjust the discharge current such that the other of the command-value number and the change-timing number is matched with one of the command-value number and the change-timing number.

This enables control of changing the discharge current after start of controlling the discharge current to be smoothly executed even if the command-value number and the change-timing number are mismatched with each other.

In a fourteenth exemplary aspect of the present disclosure, the controller is configured to modulate, based on the plural command values, the discharge control signal such that the modulated discharge control signal includes, as the information, plural pulses, at least one of a signal level and a width of each of the pulses being set relative to a reference value. The reference value is defined based on at least one of the command values.

Suitably setting the reference value enables at least one of the signal level and the width of each of the pulses to be reduced. It is therefore possible to set the pulse width or signal level for a target command value relative to the reference value corresponding to the target command value faster than setting the pulse width or signal level for the target command value based on the absolute value of the target command value.

A fifteenth exemplary aspect of the present disclosure is an ignition apparatus for controlling a discharge current in a spark plug. The ignition apparatus includes an ignition coil including a primary coil and a secondary coil connected to the spark plug, an energization circuit configured to change an energization state of the primary coil, and a controller configured to output a discharge start signal instructing a start of a discharge in the spark plug, and a discharge control signal instructing control of a discharge current in the spark plug after the start of the discharge. The ignition apparatus includes a control circuit, and a signal line connecting between the controller and the control circuit. The discharge start signal and the discharge control signal are transferred from the controller to the control circuit via the signal line. The controller is configured to modulate, based on the plural command values, the discharge control signal such that the modulated discharge control signal includes information representing the plural command values and change timings for the respective command values. The controller is configured to output the modulated discharge control signal to the control circuit after completion of output of the discharge start signal to the control circuit. The control circuit is configured to control, based on the discharge start signal and the modified discharge control signal, the energization circuit to thereby adjust the discharge current to each of the command values at a corresponding one of the change timings.

because the modulated discharge control signal, which includes information representing the plural command values and change timings for the respective command values, is transferred from the controller to the control circuit after completion of the output of the discharge start signal from the controller to the control circuit, the control circuit makes it possible to adjust the discharge current to each of the command values at the corresponding one of the change timings after start of controlling the discharge current.

BRIEF DESCRIPTION OF THE DRAWINGS

Other aspects of the present disclosure will become apparent from the following description of embodiments with reference to the accompanying drawings in which.

DETAILED DESCRIPTION OF EMBODIMENT

Figure 1:
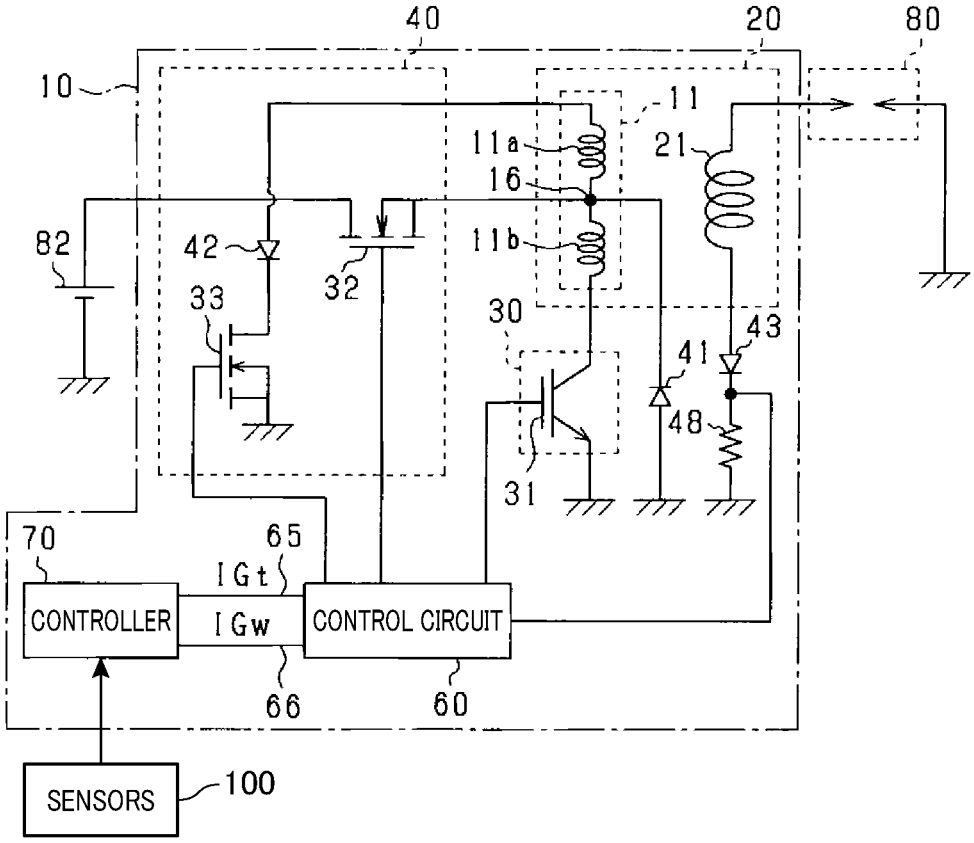
FIG. 1 is a block diagram schematically illustrating an example of the structure of an ignition apparatus according to the first embodiment of the present disclosure.

The following describes embodiments of the present disclosure with reference to the accompanying drawings. In the embodiments, like parts between the embodiments, to which like reference characters are assigned, are omitted or simplified to avoid redundant description.

First Embodiment

The following describes an ignition apparatus 10 for a multicylinder gasoline engine, i.e. an internal combustion engine, installable in a vehicle according to the first embodiment with reference to FIGS. 1 to 7.

Note that the engine is designed as, for example, a direct-injection lean-burn engine, and includes a swirl-flow controller that generates swirly flow or tumble flow of an air-fuel mixture in each cylinder. The ignition apparatus 10 is configured to ignite the air-fuel mixture in the combustion chamber of each cylinder of the engine at a controlled ignition timing. The ignition apparatus 10 is designed as a direct injection ignition apparatus using an ignition coil 20 compliant with a spark plug 80 provided in the combustion chamber of each cylinder of the engine.

Referring to FIG. 1, the ignition apparatus 10 includes the ignition coils 20, a main ignition circuit 30, an energy applying circuit 40, diodes 41 and 43, a current measurement resistor 48, a control circuit 60, a first signal line 65, a second signal line 66, and a controller 70. Note that the controller 70 can be constructed by at least part of an engine electronic control unit (ECU) that controls the engine. In other words, the engine ECU serves as the controller 70.

Figure 4:
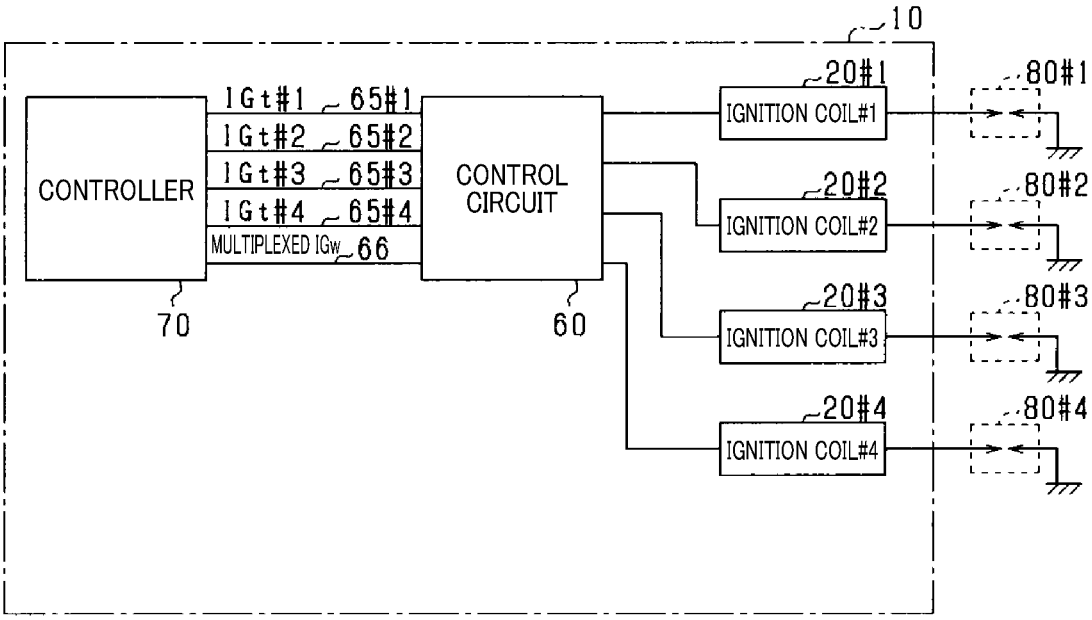
FIG. 4 is a block diagram schematically illustrating the ignition apparatus applied for a four-cylinder engine.

The spark plugs 80 are each provided in the combustion chamber of the corresponding cylinder, and the ignition coils 20 are provided for the respective spark plugs 80 (see FIG. 4). Each ignition coil 20 is comprised of a primary coil 11 and a secondary coil 21, and the ignition coil assemblies 20 are for example housed in a case. The following describes simply one ignition coil 20 provided for a corresponding spark plug 80. Note that the elements of the ignition apparatus 10 are for example housed in the case that houses the ignition coils 20.

The spark plug 80, which has a known structure, is comprised of a center electrode connected to a first end of the secondary coil, and an outer electrode disposed to surround the center electrode and grounded via, for example, the cylinder head of the engine. A second end of the secondary coil 21, which is opposite to the first end, is grounded via the diode 43 and the current measurement resistor 48. That is, the anode of the diode 43 is connected to the second end of the secondary coil 21, and the cathode of the diode 43 is connected to the current measurement resistor 48. The current measurement resistor 48, which has a predetermined resistance, is configured to measure a secondary current flowing through the secondary coil 21; the secondary current serves as a discharge current for the spark plug 80. For example, a voltage across the current measurement resistor 48 is configured to be supplied to the control circuit 60; the voltage across the current measurement resistor 48 represents a parameter indicative of the discharge current, because the resistance of the current measurement resistor 48 and the voltage across the current measurement resistor 48 enable the discharge current, i.e. the secondary current flowing through the current measurement resistor 48 to be measured.

The diode 43 is configured to prevent the occurrence of a spark discharge due to an unwanted voltage at the start of energization of the primary coil 11. The spark plug 80 is configured to generate a spark discharge across a spark gap defined between the center and outer electrodes upon electrical energy being applied between the center and outer electrodes from the secondary coil 21.

The ignition coil 20 is comprised of, for example, a common core for the primary and secondary coils 11 and 21. The primary coil 11 is comprised of a primary winding wound around the common core with a predetermined first number of turns. The secondary coil 21 is comprised of a secondary winding wound around the common core with the predetermined second number of turns, and electromagnetically coupled to the primary winding. The ignition coil 20 has a predetermined turn ratio, and the second number of turns of the secondary coil 21 is larger than the first number of turns of the primary coil 11.

The primary coil 11 has opposing first and second ends and a center tap 16, so that the primary coil 11 is comprised of a first coil portion 11*a* including the first end, and a second coil portion 11*b* including the second end; the first and second coil portions 11*a* and 11*b* are separated by the center tap 16. The cathode of the diode 41 is connected to the center tap 16, and the anode of the diode 41 is connected to a common ground of the ignition apparatus 10.

The energy applying circuit 40 includes a diode 42 and switching elements 32 and 33. The first end of the first coil portion 11*a*, which is opposite to the center tap 16, is connected to the diode 42 and the switching element 33 to the common ground. A semiconductor switching element, such as a MOSFET, is preferably used as the switching element 33. The switching element 33 causes a current to flow or shuts off the current from the first coil portion 11*a* to the common ground.

The control circuit 60 is connected to a control terminal of the switching element 33, so that the control circuit 60 can control on-off switching operations of the switching element 33. The anode of the diode 42 is connected to the first end of the first coil portion 11*a*, and the cathode of the diode 42 is connected to the switching element 33. The diode 42 is configured to prevent a current from flowing from the common ground to the first coil portion 11*a* and a battery 82 described later upon reverse connection of the battery 82 to the ignition apparatus 10.

The switching element 31 has opposing input and output terminals and a control terminal, and the input terminal of the switching element 31 is connected to the second end of the second coil portion 16*b*, which is opposite to the center tap 16. A semiconductor switching element, such as a power transistor, for example, IGBT, is preferably used as the switching element 31. The output terminal of the switching element 31 is connected to the common ground. The control circuit 60 is connected to the control terminal of the switching element 31, so that the control circuit 60 can control on-off switching operations of the switching element 31. This enables an electrical connection between the second coil portion 11*b* and the common ground to be connected or disconnected.

The center tap 16 is connected to the positive terminal of the battery 82 via the switching element 32; the negative terminal of the battery 82 is connected to the common signal ground. For example, the battery 82 consists of, for example, a known lead-acid battery, and supplies a voltage of, for example, 12 V to the center tap 16. The switching element 32 consists of, for example, a semiconductor switching element, such as a MOSFET, and causes a current to flow or shuts off the current from the battery 82 to the center tap 16.

The control circuit 60 is connected to a control terminal of the switching element 32, so that the control circuit 60 can control on-off switching operations of the switching element 32. That is, the battery 82 supplies the voltage to the center tap 16 while the switching element 32 is closed, i.e. on. Note that the switching element 31 serves as the main ignition circuit 30. The main ignition circuit 30 and the energy applying circuit 40 serve as an energization circuit for changing the energization state of the primary coil 11.

The control circuit 60 is comprised of, for example, an input/output interface, a processor, a storage, a driver, and other peripheral devices.

The controller 70 is connected to the control circuit 60 via the first and second signal lines 65 and 66.

The controller 70 is connected to sensors 100 that are operative to measure various parameters of the engine; the parameters of the engine, which will be referred to as engine parameters, include (1) The warm state of the engine (2) The rotational speed of the engine (3) The level of the engine load (4) Information indicative of whether the engine is driven in a lean-burn condition (5) The air-fuel ratio (6) The level of swirl flow of the air-fuel mixture in the engine That is, the engine parameters show the operating conditions of the engine and how the engine is controlled.

The controller 70 is configured to repeatedly or cyclically generate, based on information about the engine parameters, a main ignition signal, for example, a voltage signal, IGt and an energy application signal IGw, for example, a voltage signal, and repeatedly or cyclically output the main ignition signal IGt and the energy application signal IGw to the control circuit 60 via the respective first and second signal lines 65 and 66. In other words, the first signal line 65 enables the main ignition signal IGt to be transferred from the controller 70 to the control circuit 60 therethrough, and the second signal line 66 enables the energy application signal IGw to be transferred from the controller 70 to the control circuit 60 therethrough.

The control circuit 60 is configured to control the switching operations of the respective switching elements 31 to 33 based on the voltage across the current measurement resistor 48, the main ignition signal IGt, and the energy application signal IGw. This control starts a discharge in the spark plug 80 in main discharge control and adjusting a value of the discharge current to a command value in superimposition discharge control after the start of the discharge.

The controller 70 is configured to generate a discharge start signal that triggers the spark plug 80 to start a discharge in the main discharge control set forth above, and a discharge control signal that controls the discharge current flowing across the spark gap of the spark plug in the superimposition discharge control on or after the start of the discharge. Specifically, the controller 70 is configured to superimpose the discharge start signal and the discharge control signal on at least one of the main ignition signal IGt and the energy application signal IGw. The discharge control signal includes a command value setting signal indicative of the command value for the discharge current, and a command value switch signal that instructs a timing to switch the present command value to another command value. That is, the discharge start signal and the discharge control signal are transferred from the controller 70 to the control circuit 60 via at least one of the first and second signal lines 65 and 66.

Figure 2:
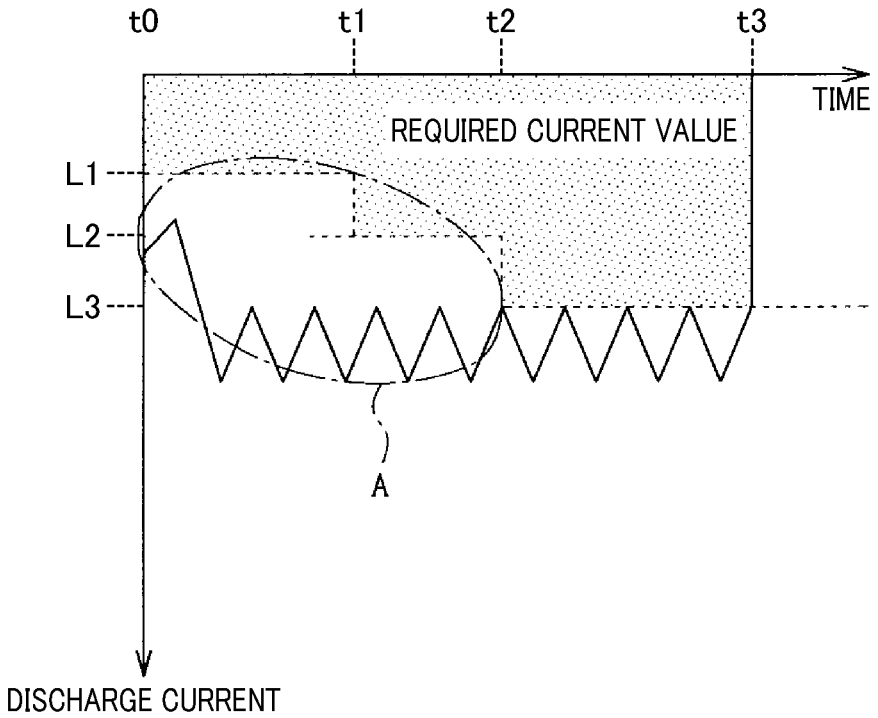
FIG. 2 is a graph schematically illustrating a relationship between change of a discharge current over time and change of a required current value over time according to a comparison control example.

FIG. 2 is a graph schematically illustrating a relationship between change of a discharge current over time and change of a required current value over time according to a comparison control example; the required current value represents a value of the discharge current required to maintain a started discharge in the spark plug 80. The comparison control example illustrated in FIG. 2 shows that, after start of a discharge by the spark plug 80 in the main discharge control, maintains the command value for the discharge current in the superimposition discharge control unchanged.

Specifically, for maintaining the started discharge, the required current value increases over time in the following order of L1, L2, and L3, so that it is necessary for the comparison control example to set the command value to a sufficient value equal to or higher than the maximum required current value, such as the value L3. This is because the comparison control example maintains the command value unchanged from time t0 to time t3.

This may cause, for a relatively early stage A (see from the time t0 to time t2) after the start of the discharge during which the discharge current in the main discharge control is sufficiently ensured, an excessively higher total discharge current than the corresponding required values L1 and L2 to flow through the spark plug 80. This therefore may result in (1) The energy consumption the spark plug 80 being greater (2) The discharge in the spark plug 80 being unsuitable for the combustion state of the air-fuel mixture (3) The wearing of the electrodes of the spark plug 80 being facilitated From this viewpoint, a control method according to the first embodiment is configured to adjust, after start of a discharge in the spark plug 80 in the main discharge control, a discharge current in the spark plug 80 to plural command values in the superimposition discharge control (see FIG. 3).

Figure 3:
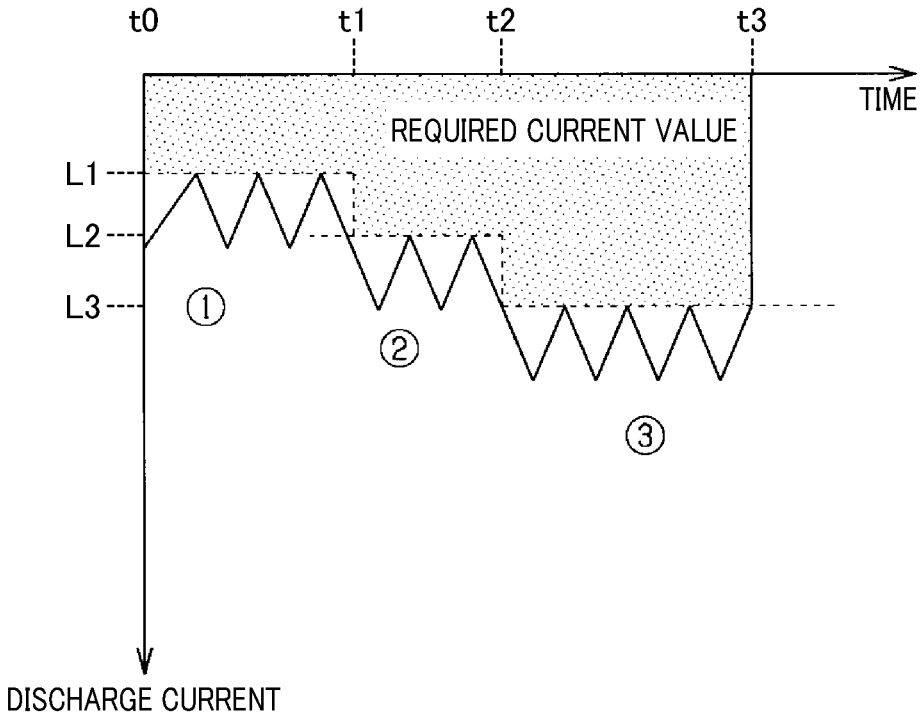
FIG. 3 is a graph schematically illustrating a relationship between change of a discharge current over time and change of a required current value over time according to the first embodiment.

Specifically, as illustrated in FIG. 3, the control method changes the discharge current in the superimposition discharge control in the following order of a command value 1, a command value 2, and a command value 3, which are respectively illustrated by the encircled numbers 1, 2, and 3, such that (1) The command value 1 is equal to or higher than the required value L1 from the time t0 to the time t1

(2) The command value 2 is equal to or higher than the required value L2 from the time t1 to the time t2

(3) The command value 3 is equal to or higher than the required value L3 from the time t2 to the time t3

This results in the discharge being maintained while preventing an excessively higher discharge current than the required values L1 to L3 from flowing across the spark gap of the spark plug 80, making it possible to (1) Reduce the consumption energy by the spark plug 80 to be smaller (2) Adjust the discharge in the spark plug 80 to be suitable for the combustion state of the air-fuel mixture Specifically, the control unit 70 outputs, to the control circuit 60, the main ignition signal IGt and the energy application signal IGw, at least one of which includes the discharge start signal and the discharge control signal. The control circuit 60 controls the main ignition circuit 30 and the energy application circuit 40 in accordance with the main ignition signal IGt transmitted through the first signal line 65 and the energy application signal IGw transmitted through the second signal line 66 to correspondingly change the discharge current to plural command values at respective controlled change timings.

FIG. 4 schematically illustrates the ignition apparatus 10 applied for a four-cylinder engine in which illustration of each the main ignition circuit 30 and the energy application circuit 40 is omitted. Note that the four cylinders of the engine will be referred to as #1 to #4, so that (1) The spark plugs 80 provided for the respective cylinders #1 to #4 will be referred to as spark plugs 80#1 to 80#4

(2) The ignition coils 20 provided for the respective spark plugs 80#1 to 80#4 will be referred to as ignition coils 20#1 to 20#4

Referring to FIG. 4, the first signal lines 65 are provided for the respective spark plugs 80#1 to 80#4 as first signal lines 65#1 to 65#4. The controller 70 is configured to generate the main ignition signals IGt for the respective spark plugs 80#1 to 80#4 as main ignition signals IGt#1 to IGt#4, and output the main ignition signals IGt#1 to IGt#4 to the control circuit 60 via the respective first signal lines 65#1 to 65#4.

The controller 70 is also configured to (1) Superimpose plural command values for the discharge current for each of the spark plugs 80#1 to 80#4 on the energy application signal IGw for the corresponding one of the spark plugs 80#1 to 80#4 to thereby multiplex the energy application signal IGw (2) Transfer, to the control circuit 70 via the second signal line 66, the multiplexed energy application signal IGw for each of the spark plugs 80#1 to 80#4 via the second signal line 66 while being synchronized with the corresponding one of the main ignition signals IGt#1 to IGt#4

That is, the multiplexed energy application signal IGw for each of the spark plugs 80#1 to 80#4 66 while being synchronized with the corresponding one of the main ignition signals IGt#1 to IGt#4 serves as a signal for transferring the plural command values to the control circuit 60.

When one of the main ignition signals IGt for a target spark plug selected from the spark plugs 80#1 to 80#4 to be ignited is transferred from the controller 70 to the control circuit 60 as a target main ignition signal, the control circuit 60 is configured to (1) Receive the target main ignition signal (2) Control the switching operations of the respective switches 31 to 33 in accordance with the voltage across the current measurement resistor 48, the target main ignition signal, and the multiplexed energy application signal IGw synchronized with the target main ignition signal This makes it possible to adjust the value of the discharge current to the plural command values superimposed on the multiplexed energy application signal IGw.

That is, the ignition apparatus 80 according to the first embodiment enables transmission of the plural command values for the discharge current using only one second signal line 66, resulting in reduction of the number of second signal lines 66.

Figure 5:
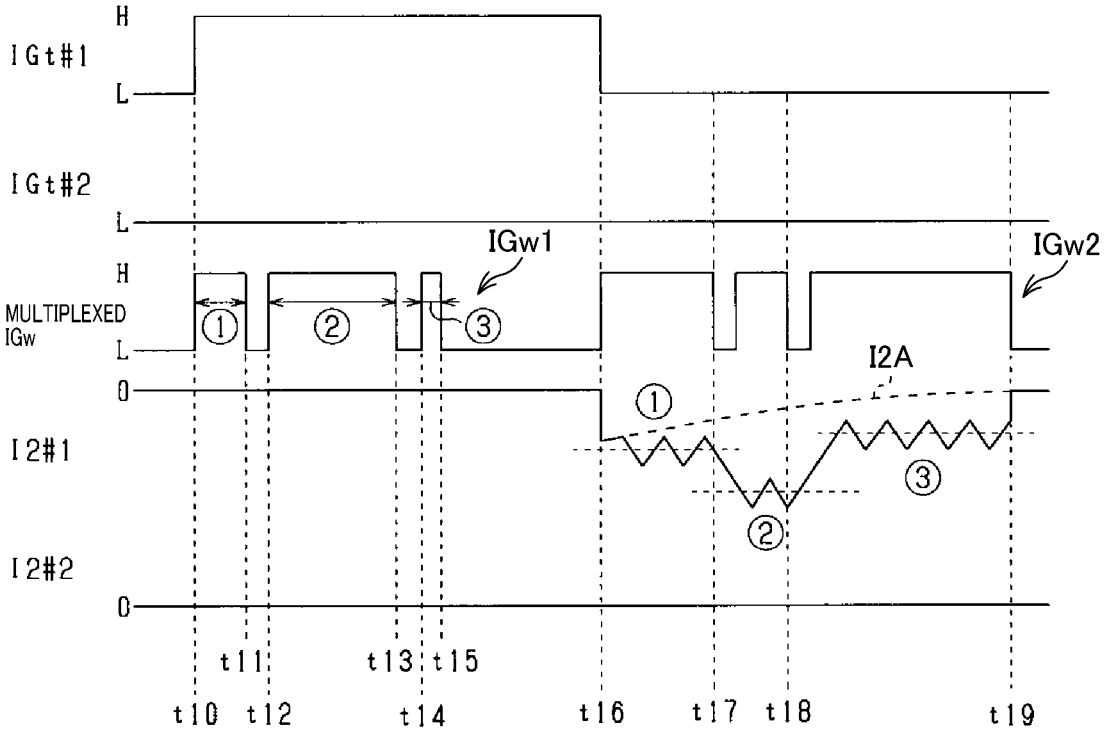
FIG. 5 is a joint timing chart schematically illustrating how the ignition apparatus illustrated in FIG. 4 is operated.

FIG. 5 schematically illustrates a timing chart representing how the ignition apparatus 10 illustrated in FIG. 4 is operated. Note that FIG. 5 illustrates a case where the ignition apparatus 10 causes a discharge to be generated in the spark plug 80#1 as an example. In FIG. 5, illustration of signals and currents associated with the spark plugs 80#3 and 80#4 is omitted.

At time t10, the controller 70 raises the main ignition signal IGt#1 from a low level (L) to a high level (H), and raises the energy application signal IGw synchronized with the main ignition signal IGt#1 from the low level to the high level. That is, the controller 70 uses binary logical high and low levels.

Then, the control circuit 60, which receives the main ignition signal IGt#1 and the energy application signal IGw, energizes the second coil portion 11*b* of the primary coil 11 of the ignition coil 20#1 corresponding to the main ignition signal IGt#1. Specifically, the control circuit 60 turns on, i.e. closes, each of the switching elements 31 and 32 to thereby cause a primary current to flow from the battery 82 to the second coil portion 11*b* of the ignition coil 20#1.

When the energy application signal IGw is changed from the high level to the low level at time t 11, the control circuit 60 measures a high-level period, i.e. a pulse width, in the energy application signal IGw, i.e. the period form the time t10 to the time t 11. The pulse width from the time t10 to the time t11 will be referred to as a pulse width W1 (see the encircled number 1 in FIG. 5). Then, the control circuit 60 sets a command value C1 based on the pulse width W1. For example, the control circuit 60 sets a command value for a pulse width such that, the wider the pulse width is, the larger the command value is.

Thereafter, at time t12, the energy application signal IGw is changed from the low level to the high level. When the energy application signal IGw is changed from the high level to the low level at time t13, the control circuit 60 similarly measures a high-level period, i.e. a pulse width, in the energy application signal IGw, i.e. the period form the time t11 to the time t12. The pulse width from the time t11 to the time t12 will be referred to as a pulse width W2 (see the encircled number 2 in FIG. 5). Then, the control circuit 60 sets a command value C2 based on the pulse width W2.

Thereafter, at time t14, the energy application signal IGw is changed from the low level to the high level. When the energy application signal IGw is changed from the high level to the low level at time t15, the control circuit 60 similarly measures a high-level period, i.e. a pulse width, in the energy application signal IGw, i.e. the period form the time t14 to the time t15. The pulse width from the time t14 to the time t15 will be referred to as a pulse width W3 (see the encircled number 3 in FIG. 5). Then, the control circuit 60 sets a command value C3 based on the pulse width W3.

That is, the control circuit 60 sets the plural command values C1 to C3 for the spark plug 80#1 while executing no energization of the other spark plugs 20#2 to 20#4 and setting no command values. Note that, in some of the other figures, an encircled number represents a command value.

The main ignition signal IGt#1 from the time t10 to the time t16 corresponds to, for example, the discharge start signal, and the energy application signal IGw from the time t10 to the time t15 corresponds to, for example, a command value setting signal IGw1 as the discharge control signal.

Thereafter, at time t16, the main ignition signal IGt#1 input to the control circuit 60 from the controller 60 falls from the high level to the low level, and the energy application signal IGw input to the control circuit 60 rises from the low level to the high level.

At that time, the control circuit 60 turns off, i.e. opens, the switching element 31 in response to the low level of the main ignition signal IGt#1 to thereby shut off the primary current from the battery 82 to the second coil portion 11*b* of the ignition coil 20#1. This causes a high voltage to be induced in the secondary coil 21 of the ignition coil 20#1, and the high voltage causes a secondary current I2#1 flowing through the secondary coil 21 of the ignition coil 20#1. That is, at the time t16, the discharge, i.e. the discharged spark, between the electrodes of the spark plug 80#1 causes the air-fuel mixture in the combustion chamber in the cylinder #1 to be ignited. This results in a discharge current corresponding to the secondary current I2#1 flow through the spark plug 80#1 in the main discharge control while being attenuated (see a dashed curve I2A in FIG. 5).

At that time, the control circuit 60 adjusts the secondary current I2#1 flowing through the secondary coil 21 of the ignition coil 20#1, which corresponds to the discharge current flowing across the spark gap of the spark plug 80#1, to the command value C1 in the superimposition discharge control.

Specifically, the control circuit 60 executes feedback control of on-off switching operations of the switching element 32 while maintaining the switching element 33 in the on state in the superimposition discharge control. This aims to adjust the secondary current I2#1, which is measured based on the voltage across the current measurement resistor 48, to be within a predetermined range including the command value C1 or a predetermined range including the command value C1 at its lower limit.

This on-off switching operations of the switching element 32 causes a primary current I1 to flow from the center tap 16 of the primary coil 11 of the ignition coil 20#1 to the first coil portion 11 a based on the battery 82.

This results in an auxiliary secondary current (see reference character I2B in FIG. 7) based on the primary current I1 in the superimposition discharge control being superimposed on the secondary current, i.e. a main secondary current, based on the primary current flowing through the second coil portion 11*b* in the main discharge mode.

This therefore enables the secondary current I2#1, which represents the sum of the main secondary current and the auxiliary secondary current, and is measured based on the voltage across the current measurement resistor 48, to be within the predetermined range including the command value C1 or the predetermined range including the command value C1 at its lower limit.

Note that, while the switching element 32 is open, i.e. in the off state, a current flows back from the first coil portion 11*a* thereto via the diode 42, the switching element 33, the common signal ground, the diode 41, and the center tap 16. This prevents an abrupt shut-off of the primary current I1 due to opening of the switching element 32, thus preventing abrupt decrease in the auxiliary discharge current.

When detecting the energy application signal input to the control circuit 60 falling from the high level to the low level at time t17, the control circuit 60 changes the command value for the discharge current from the command value C1 to the command value C2.

Then, the control circuit 60 executes feedback control of on-off switching operations of the switching element 32 while maintaining the switching element 33 in the on state in the superimposition discharge control. This aims to adjust the secondary current I2#1, which is measured based on the voltage across the current measurement resistor 48, to be within a predetermined range including the command value C2 or a predetermined range including the command value C2 at its lower limit.

This results in the auxiliary secondary current based on the primary current I1 in the superimposition discharge control being superimposed on the secondary current, i.e. the main secondary current, in the main discharge mode. This therefore enables the secondary current I2#1, which represents the sum of the main secondary current and the auxiliary secondary current, and is measured based on the voltage across the current measurement resistor 48, to be within the predetermined range including the command value C2 or the predetermined range including the command value C2 at its lower limit.

Similarly, when detecting the energy application signal input to the control circuit 60 falling from the high level to the low level at time t18, the control circuit 60 changes the command value for the discharge current from the command value C2 to the command value C3. Then, the control circuit 60 executes feedback control of on-off switching operations of the switching element 32 while maintaining the switching element 33 in the on state in the superimposition discharge control This results in the auxiliary secondary current based on the primary current I1 in the superimposition discharge control being superimposed on the secondary current, i.e. the main secondary current, in the main discharge control. This therefore enables the secondary current I2#1, which represents the sum of the main secondary current and auxiliary secondary current, and is measured based on the voltage across the current measurement resistor 48, to be within the predetermined range including the command value C3 or the predetermined range including the command value C3 at its lower limit.

When detecting the energy application signal input to the control circuit 60 falling from the high level to the low level at time t19, the control circuit 60 terminates discharging in the spark plug 80#1. This is because all the command values C1 to C3 superimposed on the energy application signal IGt synchronized with the main ignition signal IGt have been used. Specifically, the control circuit 60 opens, i.e. turns off, each of the switching elements 32 and 33, thus terminating energization of the first coil portion 11*a* of the ignition coil 20#1.

Note that a part of the energy application signal IGw from the time t16 to the time t19 corresponds to, for example, the command value switching signal IGw2, i.e. the discharge control signal.

That is, the control circuit 60 is for example configured to store therein the command values C1 to C3 for the auxiliary discharge current before actually controlling the discharge current after the occurrence of the discharge.

Figure 6:
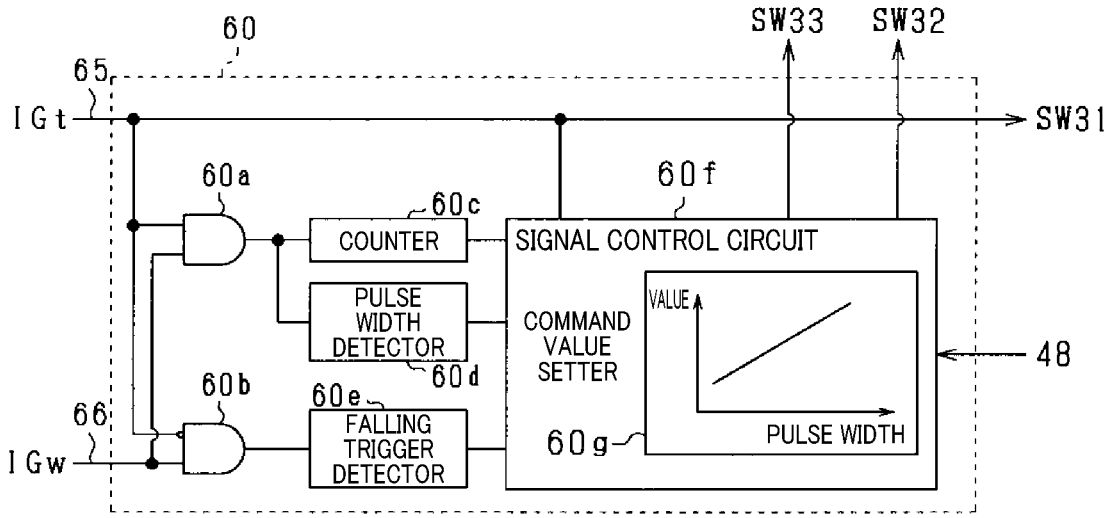
FIG. 6 is a block diagram schematically illustrating an example of the structure of a control circuit according to the first embodiment.

FIG. 6 schematically illustrates an example of the structure of the control circuit 60. Note that FIG. 6 simply illustrates the structure of the control circuit 60 for controlling energization of a selected one ignition coil 20 corresponding to a selected one spark plug 80. The selected ignition coil 20 will be referred to as a target ignition coil 20, and the selected spark plug 80 will be referred to as a target spark plug 80. This is can be applied to the following FIGS. 8, 10, 14, 16, and 18 described later.

Referring to FIG. 6, the control circuit 60 is comprised of a logical AND gate 60*a*, a logical AND gate 60*b*, a counter 60*c*, a pulse width detector 60*d*, a falling trigger detector 60*e*, and a signal control circuit 60*f*.

The logical AND gate 60*a* calculates a logical AND between the main ignition signal IGt input thereto via the first signal line 65 and the energy application signal IGw input thereto via the second signal line 66 to thereby output a first output signal. The logical AND gate 60*b* calculates a logical AND between an inversion signal of the main ignition signal IGt input thereto via the first signal line 65 and the energy application signal IGw input thereto via the second signal line 66 to thereby output a second output signal.

The counter 60*c* counts the number of pulses included in the first output signal input thereto from the logical AND gate 60*a*. Specifically, the counter 60*c* counts the number of high-level periods included in the first output signal. The pulse width detector 60*d* detects the width of each pulse included in the first output signal input thereto from the logical AND gate 60*a*. Specifically, the pulse width detector 60*d* detects the width of each high-level period included in the first output signal.

The falling trigger detector 60*e* is configured to (1) Output a high level signal each time when detecting a falling edge of each pulse included in the second output signal input thereto from the second logical AND gate 60*b*

(2) Output a low level signal while detecting no falling edges of pulses included in the second output signal input thereto from the second logical AND gate 60*b*

Specifically, the falling trigger detector 60*e* outputs the high level signal each time when detecting a falling edge from the high level to the low level in the second output signal input thereto from the second logical AND gate 60*b*, and outputs the low level signal while detecting no falling edges in the second output signal input thereto from the second logical AND gate 60*b*.

The main ignition signal IGt, the number of pulses counted by the counter 60*c*, the pulse widths detected by the pulse width detector 60*d*, and the output of the falling trigger detector 60*e* are input to the signal control circuit 60*f*.

The signal control circuit 60*f* includes a command value setter 60*g*. The command value setter 60*g* variably sets each command value for the discharge current in accordance with the corresponding one of the pulse widths detected by the pulse width detector 60*d*. Specifically, the command value setter 60*g* sets each command value for the corresponding one of the pulse widths such that, the wider the corresponding one of the pulse widths is, the larger the command value is. The signal control circuit 60*f* causes the command value setter 60*g* to set the number of command values corresponding to the number of pulses detected by the counter 60*c*. In other words, the signal control circuit 60*f* causes the command value setter 60*g* to set a command value based on the pulse width for each pulse included in the first output signal.

The signal control circuit 60*f* closes, i.e. turns on, the switching element 31 when the main ignition signal IGt input thereto via the first signal line 65 rises from the low level to the high level. In addition, the signal control circuit 60*f* opens, i.e. turns off, the switching element 31 when the main ignition signal IGt input thereto via the first signal line 65 falls from the high level to the low level.

The signal control circuit 60*f* outputs a high level signal, i.e. an on signal, to each of the switching elements 32 and 33 to thereby close the corresponding one of the switching elements 32 and 33. In addition, the signal control circuit 60*f* outputs a low level signal, i.e. an off signal, to each of the switching elements 32 and 33 to thereby open the corresponding one of the switching elements 32 and 33. Note that the signal control circuit 60*f* can be configured to output the high level signal or the low level signal to the switching element 31 in accordance with the main ignition signal IGt.

The signal control circuit 60*f* closes the switching element 32 in response to when the main ignition signal IGt input thereto vie the first signal line 65 rises from the low level to the high level, and maintains the switching element 31 in the close state within the high level of the main ignition signal IGt. Thereafter, the signal control circuit 60*f* opens the switching element 31 in response to when the main ignition signal IGt falls from the high level to the low level. This enables a main discharge to be started in the target spark plug 80. The signal control circuit 60 starts control of the discharge current at the timing when the main ignition signal IGt falls from the high level to the low level, thus adjusting the discharge current to the command value C1 corresponding to a first command value.

Specifically, the signal control circuit 60*f* closes the switching element 32 when the secondary current measured based on the voltage across the current measurement resistance 48 becomes below the command value C1, which represents, for example, lower limit of the range. This enables the auxiliary secondary current based on the primary current flowing through the first coil portion 11*a* to be superimposed on the discharge current based on the main discharge mode, resulting in an increase of the discharge current flowing across the spark gap of the spark plug 80.

Thereafter, the signal control circuit 60*f* opens the switching element 32 while maintaining the switching element 33 is closed when the secondary current measured based on the voltage across the current measurement resistance 48 exceeds an upper limit of the predetermined range whose lower limit is set to the command value C1. This enables the primary current based on the first coil portion 11*a* to flow back from the first coil portion 11*a* thereto via the diode 42, the switching element 33, the common signal ground, the diode 41, and the center tap 16.

Thereafter, the signal control circuit 60*f* closes the switching element 32 while maintaining the switching element 33 is closed when the auxiliary secondary current measured based on the voltage across the current measurement resistance 48 becomes below the upper limit of the predetermined range whose lower limit is set to the command value C1.

That is, the signal control circuit 60*f* alternately opens or closes the switching element 32 while the switching element 33 is closed as a function of the auxiliary secondary current based on the voltage across the current measurement resistance 48, thus feedback controlling, to the command value C1, the secondary current on which the auxiliary secondary current based on the primary current flowing through the first coil portion 11*a* and the discharge current based on the main discharge control are superimposed.

At the timing, i.e. a change timing of the command value, when the output of the falling trigger detector 60*e* is change from the low level to the high level, the signal control circuit 60*f* changes the present command value for the discharge current from the command value C1 to the command value C2 corresponding to a second, i.e. next, command value. Then, the signal control circuit 60*f* adjusts the discharge current to the command value C2 in the same approach of adjusting the discharge current to the command value C1.

That is, the signal control circuit 60*f* repeatedly changes the present command value for the discharge current to the next command value each time the output of the falling trigger detector 60*e* is change from the low level to the high level.

After having adjusted the last command value whose value corresponds to the counted number of the pulses measured by the counter 60*c*, the signal control circuit 60*f* terminates the discharge in the spark plug 80 when the output of the falling trigger circuit 60*e* becomes the high level.

Specifically, the signal control circuit 60*f* opens each of the switching elements 32 and 33, thus terminating energization of the first coil portion 11*a*.

That is, the control circuit 60 is configured to, for example, periodically execute an ignition routine in response to each time the main ignition signal IGt is changed from the high level to the low level; the ignition routine successively adjusts the discharge current to the individual command values included in the energy application signal IGw synchronized with the main ignition signal IGt.

Note that the signal control circuit 60 is configured to ignore, even if the output of the falling trigger circuit 60*e*, which has been changed to the high level while the secondary current is adjusted to the last command value, becomes the high level again during one ignition routine, the high-level output of the falling trigger circuit 60*e*. This prevents the secondary current from being changed to another level after the secondary level has been changed to the last command value during one ignition routine.

In addition, the signal control circuit 60 is configured to forcibly terminate the discharge in the spark plug 80 even if unused command values remain upon determining that, during one ignition routine, the period for which the output of the falling trigger circuit 60*e* is the low level has elapsed has exceeded a predetermined abnormality period.

In other words, if the number of the plural command values transmitted to the control circuit 60 is smaller than the number of the change timings represented by the output of the falling trigger detector 60*e*, the control circuit 60 is capable of successively changing the secondary current to the plural command values while ignoring the redundant change timing(s).

In addition, if the number of the change timings represented by the output of the falling trigger detector 60*e* is smaller than the number of the plural command values transferred to the control circuit 60, the control circuit 60 is capable of successively changing the secondary current to the plural command values respectively at the corresponding change timings without using the remaining command value (s) at which no change timing(s) are set.

That is, assuming that the number of the command values is referred to as a command-value number, and the number of the change timings is referred to as a change-timing number, if one of the command-value number and the change-timing number is smaller than the other thereof, change the secondary current such that the other of the command-value number and the change-timing number is matched with one of the command-value number and the change-timing number.

Figure 7:
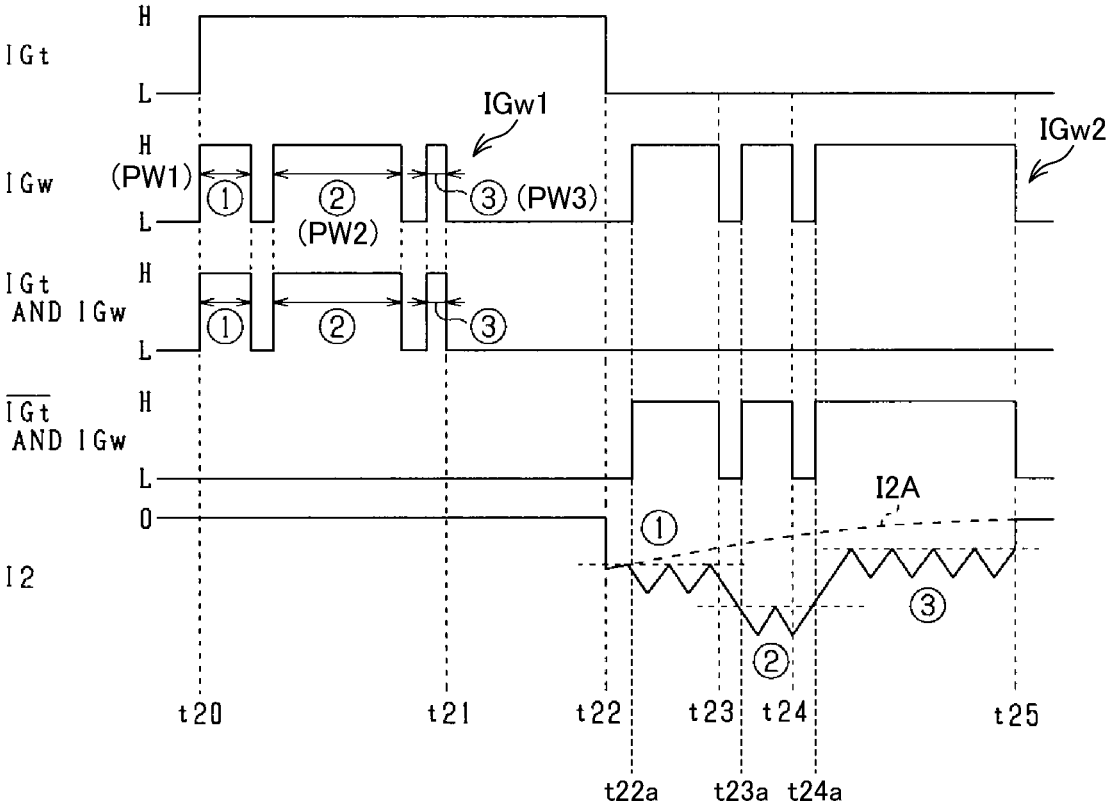
FIG. 7 is a joint timing chart schematically illustrating how the ignition apparatus illustrated in FIG. 6 is operated.

FIG. 7 schematically illustrates a timing chart representing how the control circuit 60 illustrated in FIG. 6 and the controller 70 are operated. Note that FIG. 7 illustrates (1) How a selected main ignition signal IGt for the target spark plug 80 input to the control circuit 60 is changed over time (2) How the energy application signal IGw input to the control circuit 60 is changed over time (3) How the first output signal output from the logical AND gate 66*a*, which shows the logical AND between the main ignition signal IGt and the energy application signal IGw, is changed over time (3) How the first output signal output from the logical AND gate 66*a*, which shows the logical AND between the main ignition signal IGt and the energy application signal IGw, is changed over time (4) How the second output signal output from the logical AND gate 66*b*, which shows the logical AND between the inversion signal of the main ignition signal IGt and the energy application signal IGw, is changed over time (5) How the auxiliary secondary current (see reference character I2B in FIG. 7) is changed over time Note that FIG. 7 illustrates the discharge current, i.e. main secondary current, based on the main discharge control as a dashed curve I2A.

At time t20, when the main ignition signal IGt sent from the controller 70 to the control circuit 60 rises from the low level to the high level, the control circuit 60 turns on, i.e. closes, each of the switching elements 31 and 32 to thereby cause a primary current to flow from the battery 82 to the second coil portion 11 of the target ignition coil 20. Note that the controller 70 sets the sending timing of the main ignition signal IGt and the length of the high-level period of the main ignition signal IGt from the time t20 to time t22 in accordance with the engine parameters, measured by the sensors 100, including (1) The warm state of the engine (2) The rotational speed of the engine (3) The level of the engine load (4) Information indicative of whether the engine is driven in a lean-burn condition (5) The air-fuel ratio (6) The level of swirl flow of the air-fuel mixture in the engine At that time, the controller 70 stores information about change of the required current value over time; the required current value represents the value of the discharge current required to maintain a started discharge in the spark plug 80.

While the main ignition signal IGt is in the high level (see the period from the time t20 to the time t22), the controller 70 modulates, in for example the period from the time t20 to time t21, the energy application signal IGw such that the signal IGw includes individual pulses respectively having widths PW1 to PW3 that are set variably depending on the respective command values C1 to C3 (see encircled numbers 1 to 3 in FIG. 7), i.e. the command value setting signal IGw1. The pulse widths PW1 to PW3 respectively correspond to the command values C1 to C3 that are previously determined based on the information about change of the required current value. Specifically, the controller 70 sets the pulse widths PW1 to PW3 in the energy application signal IGw so as to be proportional to the respective command values C1 to C3. To sum up, the controller 70 transmits, to the control circuit 60, the energy application signal IGw (command value setting signal IGw1) including three pulses having respective pulse widths PW1 to PW3.

During the high-level duration of the main ignition signal IGt from the time t20 to the time t22, the counter 60*c* of the control circuit 60 counts the number of pulses, that is, three pulses in this example, included in the first output signal input thereto from the logical AND gate 60*a*. The pulse width detector 60*d* detects the pulse widths PW1 to PW3 of the respective pulses included in the first output signal input thereto from the logical AND gate 60*a*. The signal control circuit 60*f* sets the command values C1 to C3 for the secondary current, i.e. discharge current, I2 including the main secondary current I2A and the auxiliary secondary current I2B. Specifically, the signal control circuit 60*f* sets the command values C1 to C3 for the secondary current I2 so as to be proportional to the respective pulse widths PW1 to PW3.

At the time t22, the controller 70 changes the high level of the main ignition signal IGt input to the control circuit 60 to the low level. At that time, the control circuit 60 turns off, i.e. opens, the switching element 31 in response to the low level of the main ignition signal IGt to thereby shut off the primary current from the battery 82 to the second coil portion 11*b* of the ignition coil 20. This causes a high voltage to be induced in the secondary coil 21 of the target ignition coil 20, and the high voltage causes a main discharge current to flow through the target spark plug 80 in the main discharge control (see a dashed curve I2A in FIG. 7). That is, at the time t22, the discharge, i.e. the discharged spark, between the electrodes of the target spark plug 80 causes the air-fuel mixture in the combustion chamber in the corresponding cylinder to be ignited.

The falling of the main ignition signal IGt at the time t22 enables the falling trigger detector 60*e* to output the high level signal. In response to the output of the high level signal as a trigger, the signal control circuit 60*f* adjusts the secondary current I2 flowing through the secondary coil 21 of the target ignition coil 20, through which the main discharge current is flowing across the spark gap of the target spark plug 8, to the command value C1 in the superimposition discharge control.

Specifically, the signal control circuit 60*f* executes feedback control of on-off switching operations of the switching element 32 while maintaining the switching element 33 in the on state in the superimposition discharge control. This aims to adjust the secondary current I2, which is measured based on the voltage across the current measurement resistor 48, to be within the predetermined range including the command value C1 or the predetermined range including the command value C1 at its lower limit.

Upon a predetermined time interval having elapsed since changing the main ignition signal IGt from the high level to the low level at the time t22, the controller 70 raises the energy application signal IGw, i.e. the command value switching signal IGw2, input to the control circuit 60 from the low level to the high level at time t22*a*.

The controller 70 previously determines a change timing suitable for the command value C1 based on a predetermined time interval having elapsed since the time t22*a*, and changes the energy application signal IGw from the high level to the low level at the change timing suitable for the command value C1 at time t23.

The falling of the energy application signal IGw at the time t23 enables the falling trigger detector 60*e* to output the high level signal. In response to the output of the high level signal as a trigger, the signal control circuit 60*f* changes the secondary current I2 from the command value C1 to the command value C2 in the superimposition discharge control in the same manner as the adjustment of the secondary current I2 to the command value C1. The falling of the secondary current I2 from the high level to the low level is detected by the falling trigger detector 60*e*.

Upon a predetermined time interval having elapsed since changing the main ignition signal IGt from the high level to the low level at the time t23, the controller 70 raises the energy application signal IGw, i.e. the command value switching signal IGw2, input to the control circuit 60 from the low level to the high level at time t23*a*.

The controller 70 previously determines a change timing suitable for the command value C2 based on a predetermined time interval having elapsed since the time t23*a*, and changes the energy application signal IGw from the high level to the low level at the change timing suitable for the command value C2 at time t24.

The falling of the energy application signal IGw at the time t24 enables the falling trigger detector 60*e* to output the high level signal. In response to the output of the high level signal as a trigger, the signal control circuit 60*f* changes the secondary current I2 from the command value C2 to the command value C3 in the superimposition discharge control in the same manner as the adjustment of the secondary current I2 to the command value C1. The falling of the secondary current I2 from the high level to the low level is detected by the falling trigger detector 60*e*.

Upon a predetermined time interval having elapsed since changing the main ignition signal IGt from the high level to the low level at the time t23, the controller 70 raises the energy application signal IGw, i.e. the command value switching signal IGw2, input to the control circuit 60 from the low level to the high level at time t24*a*.

The controller 70 previously determines a change timing suitable for the command value C3 based on a predetermined time interval having elapsed since the time t24*a*. Then, the controller 70 changes the energy application signal IGw from the high level to the low level at the change timing suitable for the command value C3 at time t25. The falling of the secondary current I2 from the high level to the low level is detected by the falling trigger detector 60*e*.

At that time, because the number of command values that have been adjusted by the control circuit 60 has reached the number of pulses counted by the counter 60*c*, the control circuit 60 terminates the discharge in the target spark plug 80.

Note that the main ignition signal IGt having the high-level duration from the time t20 to the time t22 corresponds to, for example, the discharge start signal, and the energy application signal IGw from the time t20 to the time t21 corresponds to, for example, the command value setting signal IGw1 as the discharge control signal. The energy application signal IGw from the time t22 to the time t25 corresponds to, for example, the command value switching signal IGw2 as the discharge control signal.

The ignition apparatus 10 according to the first embodiment obtains the following benefits.

The ignition apparatus 10 is configured such that the first and second signal lines 65 and 66 communicably connect between the controller 70 and the control circuit 60. The controller 70 transfers the discharge start signal, i.e. the main ignition signal IGt, to the control circuit 60 via the first signal line 65, and transfers the discharge control signal included in the energy application signal IGw to the control circuit 60 via the second signal line 66. That is, at least two signal lines 65 and 66 enable the discharge start signal and the discharge control signal to be transmitted from the controller 70 to the control circuit 60.

The controller 70 is configured to variably set the widths of pulses included in the discharge control signal, i.e. the command value setting signal IGw1, in accordance with the respective command values C1 to C3; these pulses represent the respective command values C1 to C3. The controller 70 is also configured to change the level of the discharge control signal, i.e. the command value switching signal IGw2, for each of the change timings of the respective command values C1 to C3, after start of controlling the discharge current flowing across the spark gap of the spark plug 80. This enables change of the level of the discharge current to be instructed after the start of controlling the discharge current flowing across the spark gap of the spark plug 80.

The control circuit 60 is configured to control the energization circuits, i.e. the main ignition circuit 30 and the energy application circuit 40, in accordance with the discharge start signal and the discharge control signal input thereto from the controller 70 via the first and second signal lines 65 and 66. This configuration enables the discharge current to be adjusted to the command values C1 to C3 at the respective change timings.

The controller 70 is configured to change the level of the discharge control signal at each of the change timings after terminating the output of the discharge start signal, that is, after the time t22. This configuration enables the level of the discharge current to be changed after the start of a discharge in the spark plug 80, i.e. the start of controlling the discharge current flowing across the spark gap of the spark plug 80.

The controller 70 is configured to cause the level of the discharge control signal to fall at each of the change timings of the command values. This configuration enables setting the falling timings of the level of the discharge control signal to instruct the control circuit 60 about the respective change timings of the command values. This therefore makes it possible to accurately instruct the control circuit 60 about the change timing of each of the command values C1 to C3 in real time with smaller information quantity.

The ignition apparatus 10 enables one of available signal lines to be used as the first signal line 65 through which the discharge start signal is transferred from the controller 70 to the control circuit 60.

The ignition apparatus 10 is configured to (1) Transfer, from the controller 70 to the control circuit 60, the discharge start signal (2) Transfer, from the controller 70 to the control circuit 60 via the second signal line 66, the discharge control signal in which the pulses, whose widths are individually set based on the respective command values C1 to C3, are included in synchronization with the discharge start signal This configuration therefore enables information about the command levels C1 to C3 to be transmitted from the controller 70 to the control circuit 60 while transferring the discharge start signal from the controller 70 to the control circuit 60.

The ignition apparatus 10 makes it possible to superimpose (1) The command values C1 to C3 on the discharge control signal IGw1 transferred from the controller 70 to the control circuit 60 via the second signal line 66

(2) The signals that instruct the control circuit 60 about the change timings of the respective command values C1 to C3 on the discharge control signal IGw2 transferred from the controller 70 to the control circuit 60 via the second signal line 66

This configuration enables one of usually transferred signals between the controller 70 and the control circuit 60 to be used as the discharge start signal, making it possible to modify a commonly available ignition apparatus to obtain the ignition apparatus 10.

The control circuit 60 is configured to (1) Calculate the logical AND between the main ignition signal IGt and the energy application signal IGw, i.e. the command value setting signal IGw1, to thereby calculate the command values C1 to C3

(2) Calculate the logical AND between the inversion of the main ignition signal IGt and the energy application signal IGw, i.e. the command value switching signal IGw2, to thereby calculate the change timings of the respective command values C1 to C3

Simple calculations, such as the logical AND operations, enable the command values C1 to C3 included in the energy application signal IGw1 synchronized with the main ignition signal IGt to be distinguished from the change timings of the respective command values C1 to C3 included in the energy application signal IGw2 sent after the end of the transmission of the main ignition signal IGt.

If the number of the plural command values transferred to the control circuit 60 is smaller than the number of the change timings, the control circuit 60 is configured to successively change the secondary current to the plural command values while ignoring the redundant change timing(s).

In addition, if the number of the change timings is smaller than the number of the plural command values transferred to the control circuit 60, the control circuit 60 is configured to successively change the secondary current to the plural command values respectively at the corresponding change timings without using the remaining command value(s) at which no change timing(s) are set.

This configuration therefore makes it possible to reliably execute control of changing the discharge current after the start of controlling the discharge current even if the number of the change timings is mismatched with the number of the plural command values.

The ignition apparatus 10 is configured to set the command values C1 to C3 of the secondary current I2 before the generation of a discharge in the spark plug 80, making it possible to prevent the setting of the command values for the secondary current I2 from being subjected to adverse effects of noise that may be generated during the generation of a discharge, i.e. the ignition of the air-fuel mixture.

The ignition apparatus 10 is configured to generate each of the main ignition signal IGt and the energy application signal IGw having one of the high and low levels, making it possible to configure the simpler circuit structure of the ignition apparatus 10.

Second Embodiment

Figure 8:
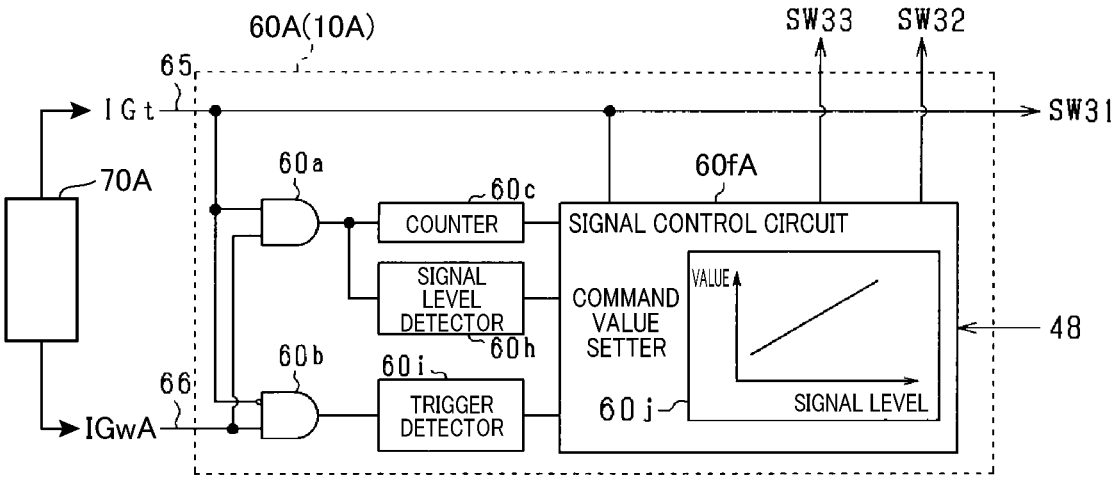
FIG. 8 is a block diagram schematically illustrating an example of the structure of a control circuit of an ignition apparatus according to the second embodiment of the present disclosure.
Figure 9:
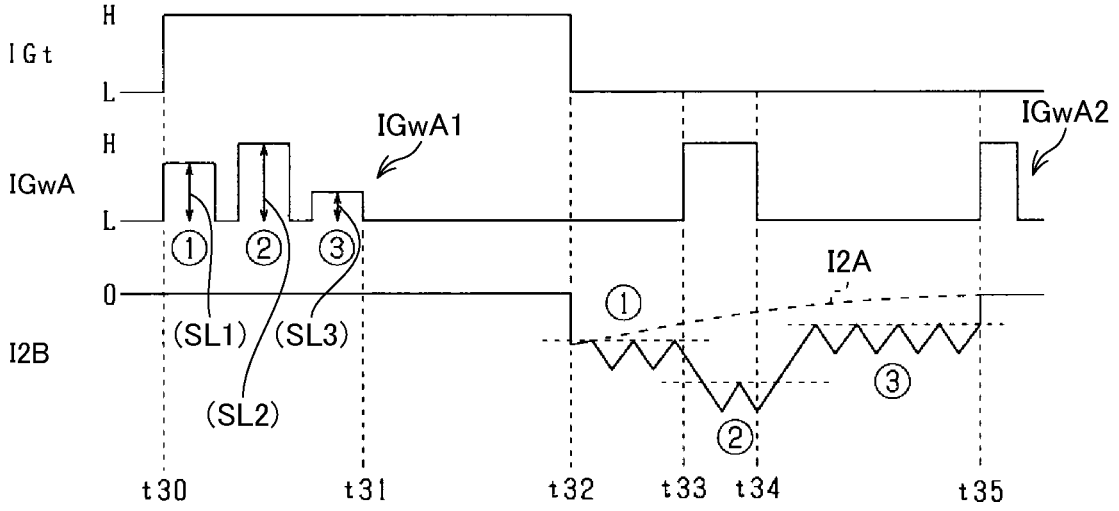
FIG. 9 is a joint timing chart schematically illustrating how the ignition apparatus illustrated in FIG. 8 is operated.

The following describes the second embodiment of the present disclosure with reference to FIGS. 8 and 9. The second embodiment differs from the first embodiment in the following points. So, the following mainly describes the different points. Note that, in the following second to seventh embodiments, illustration of the sensors 100 is omitted.

The ignition apparatus 10A according to the second embodiment is configured such that the structure of a control circuit 60A is partly different from the structure of the control circuit 60 according to the first embodiment, and the energy application signal IGwA including the command value setting signal IGwA1 and the command value switching signal IGwA2 is different from the energy application signal IGw according to the first embodiment.

FIG. 8 schematically illustrates an example of the structure of the control circuit 60A.

Referring to FIG. 8, the control circuit 60A is comprised of a signal level detector 60*h*, a trigger detector 60*i*, and a signal control circuit 60*f*A including a command value setter 60*g* in addition to the logical AND gate 60*a*, logical AND gate 60*b*, and counter 60*c*. That is, the pulse width detector 60*d*, falling trigger detector 60*e*, and the signal control circuit 60*f* are eliminated.

The signal level detector 60*h* detects the signal level, i.e. the voltage level, of each pulse included in the first output signal input thereto from the logical AND gate 60*a*. Specifically, the signal level detector 60*h* detects the signal level of the first output signal except for the low level, i.e. zero level.

The trigger detector 60*i* is configured to (1) Output a high level signal each time when detecting a rising edge or a falling edge of each pulse included in the second output signal input thereto from the second logical AND gate 60*b*

(2) Output a low level signal while detecting no rising and falling edges of pulses included in the second output signal input thereto from the second logical AND gate 60*b*

Specifically, the trigger detector 60*i* outputs the high level signal each time when detecting an edge in the second output signal input thereto from the second logical AND gate 60*b*, and outputs the low level signal while detecting no edges in the second output signal input thereto from the second logical AND gate 60*b*.

The main ignition signal IGt, the number of pulses counted by the counter 60*c*, the signal levels detected by the signal level detector 60*h*, and the output of the trigger detector 60*i* are input to the signal control circuit 60*f*A.

The signal control circuit 60*f*A includes a command value setter 60*j*. The command value setter 60*j* variably sets each command value for the discharge current in accordance with the corresponding one of the signal levels detected by the signal level detector 60*h*. Specifically, the command value setter 60*j* sets each command value for the corresponding one of the pulse widths such that, the wider the corresponding one of the signal levels is, the larger the command value is. The signal control circuit 60*f*A causes the command value setter 60*j* to set the number of command values corresponding to the number of pulses detected by the counter 60*c*.

Like the signal control circuit 60*f*, the signal control circuit 60*f*A alternately opens or closes the switching element 32 while the switching element 33 is closed as a function of the auxiliary secondary current based on the voltage across the current measurement resistance 48, thus feedback controlling, to the command value C1, the secondary current on which the auxiliary secondary current based on the primary current flowing through the first coil portion 11*a* and the discharge current based on the main discharge control are superimposed.

At the timing, i.e. a change timing of the command value, when the output of the trigger detector 60*i* is change from the low level to the high level, the signal control circuit 60*f*A changes the present command value for the discharge current from the command value C1 to the command value C2 corresponding to a second, i.e. next, command value. Then, the signal control circuit 60*f*A adjusts the discharge current to the command value C2 in the same approach of adjusting the discharge current to the command value C1.

That is, the signal control circuit 60*f*A repeatedly changes the present command value for the discharge current to the next command value each time the output of the trigger circuit 60*i* is change from the low level to the high level.

A controller 70A is configured to generate the energy application signal IGwA different from the energy application signal IGw, which will be described later.

FIG. 9 schematically illustrates a timing chart representing how the control circuit 60A and the controller 70A illustrated in FIG. 8 are operated. Note that FIG. 9 illustrates (1) How a selected main ignition signal IGt for the target spark plug 80 input to the control circuit 60A is changed over time (2) How the energy application signal IGwA input to the control circuit 60A is changed over time (3) How the auxiliary secondary current (see reference character I2B in FIG. 9) is changed over time At time t30, when the main ignition signal IGt sent from the controller 70A to the control circuit 60A rises from the low level to the high level, the control circuit 60A turns on, i.e. closes, each of the switching elements 31 and 32 to thereby cause a primary current to flow from the battery 82 to the second coil portion 11 of the target ignition coil 20. Note that the controller 70A sets the sending timing of the main ignition signal IGt and the length of the high-level period of the main ignition signal IGt from the time t30 to time t32 in accordance with the engine parameters, measured by the sensors 100 set forth above.

At that time, the controller 70A stores information about change of the required current value over time; the required current value represents the value of the discharge current required to maintain a started discharge in the spark plug 80.

While the main ignition signal IGt is in the high level (see the period from the time t30 to the time t32), the controller 70A modulates, in for example the period from the time t30 to time t31, the energy application signal IGwA, i.e. the command value setting signal IGwA1, such that the signal IGwA includes individual three pulses, i.e. three separated signal levels, SL1 to SL3 that are set variably depending on the respective command values C1 to C3 (see encircled numbers 1 to 3 in FIG. 9). The signal levels SL1 to S13 respectively correspond to the command values C1 to C3 that are previously determined based on the information about change of the required current value.

Specifically, the controller 70A adjusts the energy application signal IGwA such that the energy application signal IGwA has the signal levels SL1 to SL3 so as to be proportional to the respective command values C1 to C3. To sum up, the controller 70A transmits, to the control circuit 60A, the energy application signal IGw (command value setting signal IGw1) including three pulses having respective signal levels SL1 to SL3.

During the high-level duration of the main ignition signal IGt from the time t30 to the time t32, the counter 60*c* of the control circuit 60A counts the number of pulses, that is, three pulses in this example, included in the first output signal input thereto from the logical AND gate 60*a*. The signal level detector 60*h* detects the signal levels SL1 to SL3 of the respective pulses included in the first output signal input thereto from the logical AND gate 60*a*. The signal control circuit 60*f*A sets the command values C1 to C3 for the secondary current, i.e. discharge current, I2 including the main secondary current I2A and the auxiliary secondary current I2B. Specifically, the signal control circuit 60*f*A sets the command values C1 to C3 for the secondary current I2 so as to be proportional to the respective signal levels SL1 to SL3.

At the time t32, the controller 70A changes the high level of the main ignition signal IGt input to the control circuit 60A to the low level. At that time, the control circuit 60A turns off, i.e. opens, the switching element 31 in response to the low level of the main ignition signal IGt to thereby shut off the primary current from the battery 82 to the second coil portion 11*b* of the ignition coil 20. This causes a high voltage to be induced in the secondary coil 21 of the target ignition coil 20, and the high voltage causes a main discharge current to flow through the target spark plug 80 in the main discharge control (see a dashed curve I2A in FIG. 9).

The falling of the main ignition signal IGt at the time t32 enables the trigger detector 60*i* to output the high level signal. In response to the output of the high level signal as a trigger, the signal control circuit 60*f*A adjusts the secondary current I2 flowing through the secondary coil 21 of the target ignition coil 20, through which the main discharge current is flowing across the spark gap of the target spark plug 8, to the command value C1 in the superimposition discharge control.

Specifically, the signal control circuit 60*f*A executes feedback control of on-off switching operations of the switching element 32 while maintaining the switching element 33 in the on state in the superimposition discharge control. This aims to adjust the secondary current I2, which is measured based on the voltage across the current measurement resistor 48, to be within the predetermined range including the command value C1 or the predetermined range including the command value C1 at its lower limit.

The controller 70A previously determines a change timing suitable for the command value C1 based on a predetermined time interval having elapsed since the time t32.

In addition, the signal control circuit 60*f*A changes the signal level of the energy application signal IGwA from the low level to the high level at the change timing suitable for the command value C1 at time t33. This rising edge of the energy application signal IGwA from the low level to the high level is detected by the trigger detector 60*i*, so that the high level signal is output from the trigger detector 60*i*.

In response to the high level signal of the trigger detector 60*i* at the time t33 as a trigger, the signal control circuit 60*f*A changes the secondary current I2 from the command value C1 to the command value C2 in the superimposition discharge control in the same manner as the adjustment of the secondary current I2 to the command value C1.

In addition, the signal control circuit 60*f*A causes the signal level of the energy application signal IGwA to fall from the high level to the low level at the change timing suitable for the command value C2 at time t34. This falling edge of the energy application signal IGwA from the high level to the low level is detected by the trigger detector 60*i*, so that the high level signal is output from the trigger detector 60*i*.

In response to the high level signal of the trigger detector 60*i* at the time t34 as a trigger, the controller 70A changes the secondary current I2 from the command value C2 to the command value C3 in the superimposition discharge control in the same manner as the adjustment of the secondary current I2 to the command value C1.

The controller 70A previously determines a change timing suitable for the command value C3 based on a predetermined time interval having elapsed since the time t34. Then, the controller 70A changes the energy application signal IGwA from the low level to the high level at the change timing suitable for the command value C3 at time t35. This rising edge of the energy application signal IGwA from the low level to the high level is detected by the trigger detector 60*i*, so that the high level signal is output from the trigger detector 60*i*.

Because the number of command values that have been adjusted by the control circuit 60A has reached the number of pulses counted by the counter 60*c*, in response to the high level signal of the trigger detector 60*i* at the time t35 as a trigger, the control circuit 60A terminates the discharge in the target spark plug 80.

Note that, when a predetermined time interval has elapsed since the rising of the energy application signal IGwA, the controller 70A causes the energy application signal IGwA to fall from the high level to the low level. Although the trigger detector 60*i* detects this falling edge, and outputs the high level signal, the control circuit 60A prevents change of the command value for the secondary current I2.

Note that the main ignition signal IGt having the high-level duration from the time t30 to the time t32 corresponds to, for example, the discharge start signal, and the energy application signal IGwA from the time t30 to the time t31 corresponds to, for example, the command value setting signal IGwA1 as the discharge control signal. The energy application signal IGwA from the time t33 to the time t35 corresponds to, for example, the command value switching signal IGwA2 as the discharge control signal.

The ignition apparatus 10A according to the second embodiment obtains the following benefits especially, which are different from the above benefits obtained in the first embodiment.

The controller 70A is configured to adjust the discharge control signal, i.e. the command value setting signal IGwA1, in accordance with the respective command values C1 to C3 such that the command value setting signal IGwA1 has individual pulses, i.e. separated signal levels; these levels represent the respective command values C1 to C3. The controller 70A is also configured to change the level of the command value switching signal IGwA2 for each of the change timings of the respective command values C1 to C3, after start of controlling the discharge current flowing across the spark gap of the spark plug 80. This enables change of the level of the discharge current to be instructed after the start of controlling the discharge current flowing across the spark gap of the spark plug 80.

The controller 70A is configured to raise the level of the command value switching signal or cause the level of the command value switching signal to fall at each of the change timings of the command values. This configuration enables setting the rising timings and/or falling timings of the level of the command value switching signal to instruct the control circuit 60A about the respective change timings of the command values. This therefore makes it possible to accurately instruct the control circuit 60A about the change timing of each of the command values C1 to C3 in real time with smaller information quantity.

The ignition apparatus 10A is configured to (1) Transfer, from the controller 70A to the control circuit 60A, the discharge start signal (2) Transfer, from the controller 70A to the control circuit 60A via the second signal line 66, the discharge control signal in which the pulses, whose levels are individually set based on the respective command values C1 to C3, are included in synchronization with the discharge start signal This configuration therefore enables information about the command levels C1 to C3 to be transmitted from the controller 70A to the control circuit 60A while transferring the discharge start signal from the controller 70A to the control circuit 60A.

The controller 70A is configured to adjust the discharge control signal, i.e. the command value setting signal IGwA1, in accordance with the command values C1 to C3 such that the discharge control signal has individual pulses, i.e. individual separated levels; these levels represent the respective command values C1 to C3. This configuration enables time required to instruct the control circuit 60A about each command value to be shortened as compared with the configuration that variably sets the widths of pulses in the discharge control signal in accordance with the respective command values C1 to C3 (see FIG. 7). This therefore makes it possible to execute fine-grained control of the secondary current using larger command values.

Third Embodiment

Figure 10:
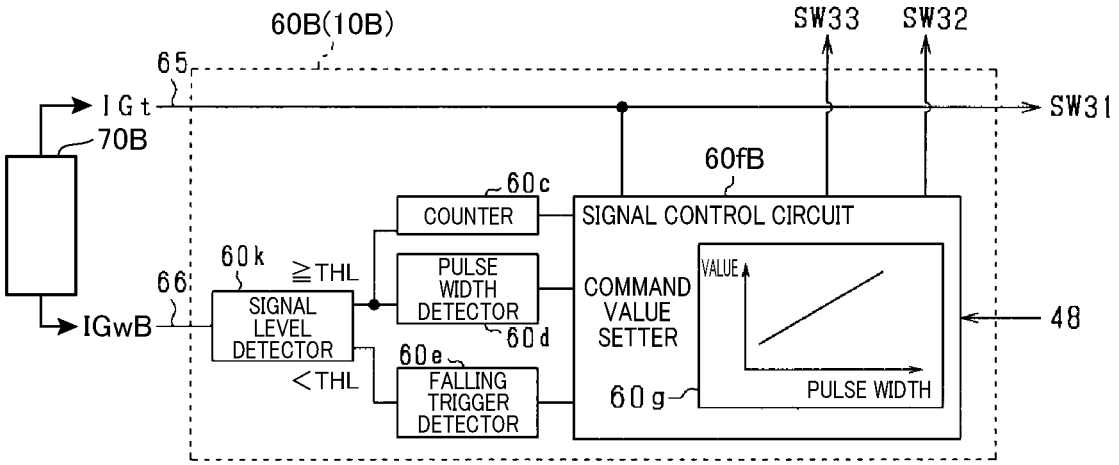
FIG. 10 is a block diagram schematically illustrating an example of the structure of a control circuit of an ignition apparatus according to the third embodiment of the present disclosure.
Figure 11:
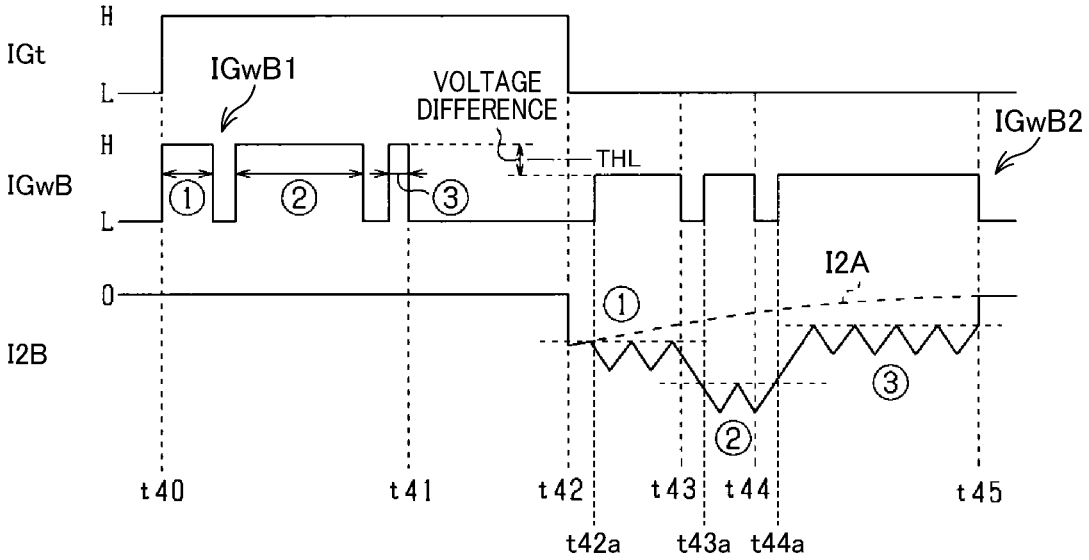
FIG. 11 is a joint timing chart schematically illustrating how the ignition apparatus illustrated in FIG. 10 is operated.

The following describes the third embodiment of the present disclosure with reference to FIGS. 10 and 11. The third embodiment differs from the first embodiment in the following points. So, the following mainly describes the different points.

The ignition apparatus 10B according to the third embodiment is configured such that the structure of a control circuit 60B is partly different from the structure of the control circuit 60 according to the first embodiment, and the energy application signal IGwB including the command value setting signal IGwB1 and the command value switching signal IGwB2 is different from the energy application signal IGw according to the first embodiment.

FIG. 10 schematically illustrates an example of the structure of the control circuit 60B.

Referring to FIG. 10, the control circuit 60B is comprised of a signal level detector 60*k* in addition to the counter 60*c*, pulse width detector 60*d*, falling trigger detector 60*e*, and signal control circuit 60*f* including a command value setter 60*g*. That is, the logical AND gate 60*a* and logical AND gate 60*b* are replaced with the signal level detector 60*k*.

The signal level detector 60*k* detects the signal level, i.e. the voltage level, of each pulse included in the energy application signal IGwB input thereto from the controller 70. Specifically, the signal level detector 60*k* detects the signal level of the energy application signal IGwB except for the low level, i.e. zero level.

Then, the signal level detector 60*k* outputs, to the counter 60*c* and the pulse width detector 60*d*, at least one pulse upon the level of the at least one pulse being equal to or higher than a threshold level THL. The signal level detector 60*k* also outputs, to the falling trigger detector 60*e*, at least one pulse upon the level of the at least one pulse is lower than the threshold level THL.

The main ignition signal IGt, the number of pulses counted by the counter 60*c*, the pulse widths detected by the pulse width detector 60*d*, and the output of the falling trigger detector 60*e* are input to the signal control circuit 60*f*.

A controller 70B is configured to generate the energy application signal IGwB different from the energy application signal IGw, which will be described later.

FIG. 11 schematically illustrates a timing chart representing how the control circuit 60B illustrated in FIG. 10 and the controller 70 are operated. Note that FIG. 11 illustrates (1) How a selected main ignition signal IGt for the target spark plug 80 input to the control circuit 60B is changed over time (2) How the energy application signal IGwB input to the control circuit 60B is changed over time (3) How the first output signal output from the logical AND gate 66*a*, which shows the logical AND between the main ignition signal IGt and the energy application signal IGwA, is changed over time (3) How the auxiliary secondary current (see reference character I2B in FIG. 11) is changed over time At time t40, when the main ignition signal IGt sent from the controller 70 to the control circuit 60B rises from the low level to the high level, the control circuit 60B turns on, i.e. closes, each of the switching elements 31 and 32 to thereby cause a primary current to flow from the battery 82 to the second coil portion 11 of the target ignition coil 20. Note that the controller 70 sets the sending timing of the main ignition signal IGt and the length of the high-level period of the main ignition signal IGt from the time t40 to time t41 in accordance with the engine parameters, measured by the sensors 100 set forth above.

At that time, the controller 70 stores information about change of the required current value over time; the required current value represents the value of the discharge current required to maintain a started discharge in the spark plug 80.

While the main ignition signal IGt is in the high level (see the period from the time t40 to the time t42), the controller 70 variably sets, in for example the period from the time t40 to time t41, pulses respectively having widths PW1 to PW3 in the energy application signal IGwB (see encircled numbers 1 to 3 in FIG. 11), i.e. the command value setting signal IGwB1. The pulse widths PW1 to PW3 respectively correspond to the command values C1 to C3 that are previously determined based on the information about change of the required current value.

Specifically, the controller 70 sets the pulse widths PW1 to PW3 in the energy application signal IGwB so as to be proportional to the respective command values C1 to C3. To sum up, the controller 70 transmits, to the control circuit 60B, the energy application signal IGwB (command value setting signal IGwB1) including three pulses having respective pulse widths PW1 to PW3.

During the high-level duration of the main ignition signal IGt from the time t40 to the time t42, the counter 60*c* of the control circuit 60A counts the number of pulses, that is, three pulses in this example, input thereto from the signal level detector 60*k*. The signal level detector 60*h* detects the pulse widths PW1 to PW3 of the respective pulses input thereto from the signal level detector 60*k*. The signal control circuit 60*f* sets the command values C1 to C3 for the secondary current I2 so as to be proportional to the respective pulse widths PW1 to PW3.

At the time t42, the controller 70 changes the high level of the main ignition signal IGt input to the control circuit 60B to the low level. At that time, the control circuit 60B turns off, i.e. opens, the switching element 31 in response to the low level of the main ignition signal IGt to thereby shut off the primary current from the battery 82 to the second coil portion 11*b* of the ignition coil 20. This causes a high voltage to be induced in the secondary coil 21 of the target ignition coil 20, and the high voltage causes a main discharge current to flow through the target spark plug 80 in the main discharge control (see a dashed curve I2A in FIG. 11).

The falling of the main ignition signal IGt at the time t42 enables the falling trigger detector 60*e* to output the high level signal. In response to the output of the high level signal as a trigger, the signal control circuit 60*f*B adjusts the secondary current I2 flowing through the secondary coil 21 of the target ignition coil 20, through which the main discharge current is flowing across the spark gap of the target spark plug 8, to the command value C1 in the superimposition discharge control.

Specifically, the signal control circuit 60*f*B executes feedback control of on-off switching operations of the switching element 32 while maintaining the switching element 33 in the on state in the superimposition discharge control. This aims to adjust the secondary current I2, which is measured based on the voltage across the current measurement resistor 48, to be within the predetermined range including the command value C1 or the predetermined range including the command value C1 at its lower limit.

Upon a predetermined time interval having elapsed since changing the main ignition signal IGt from the high level to the low level at the time t42, the controller 70 raises, up to a predetermined signal level SL10, the energy application signal IGwB, i.e. the command value switching signal IGw2, input to the control circuit 60B from the low level to the high level at time t42*a*; the signal level SL10 is set to be lower than the threshold level THL.

The controller 70 previously determines a change timing suitable for the command value C1 based on a predetermined time interval having elapsed since the time t42*a*, and changes the energy application signal IGwB from the high level to the low level at the change timing suitable for the command value C1 at time t43.

The falling of the energy application signal IGwB at the time t43 enables the falling trigger detector 60*e* to output the high level signal. In response to the output of the high level signal as a trigger, the signal control circuit 60*f*B, the signal control circuit 60*f* changes the secondary current I2 from the command value C1 to the command value C2 in the superimposition discharge control in the same manner as the adjustment of the secondary current I2 to the command value C1. The falling of the secondary current I2 from the high level to the low level is detected by the falling trigger detector 60*e*.

Upon a predetermined time interval having elapsed since changing the main ignition signal IGt from the high level to the low level at the time t23, the controller 70 raises, up to the signal level SL10, the energy application signal IGw, i.e. the command value switching signal IGw2, input to the control circuit 60 from the low level to the high level at time t43*a*.

The controller 70 previously determines a change timing suitable for the command value C2 based on a predetermined time interval having elapsed since the time t43*a*, and changes the energy application signal IGwB from the high level to the low level at the change timing suitable for the command value C2 at time t44.

The falling of the energy application signal IGwB at the time t44 enables the falling trigger detector 60*e* to output the high level signal. In response to the output of the high level signal as a trigger, the signal control circuit 60*f* changes the secondary current I2 from the command value C2 to the command value C3 in the superimposition discharge control in the same manner as the adjustment of the secondary current I2 to the command value C1. The falling of the secondary current I2 from the high level to the low level is detected by the falling trigger detector 60*e*.

Upon a predetermined time interval having elapsed since changing the main ignition signal IGt from the high level to the low level at the time t23, the controller 70 raises, up to the signal level SL10, the energy application signal IGw, i.e. the command value switching signal IGw2, input to the control circuit 60 from the low level to the high level at time t44*a*.

The controller 70 previously determines a change timing suitable for the command value C3 based on a predetermined time interval having elapsed since the time t44*a*. Then, the controller 70 changes the energy application signal IGw from the high level to the low level at the change timing suitable for the command value C3 at time t45. The falling of the secondary current I2 from the high level to the low level is detected by the falling trigger detector 60*e*.

At that time, because the number of command values that have been adjusted by the control circuit 60 has reached the number of pulses counted by the counter 60*c*, the control circuit 60B terminates the discharge in the target spark plug 80.

Note that the main ignition signal IGt having the high-level duration from the time t40 to the time t42 corresponds to, for example, the discharge start signal, and the energy application signal IGwB from the time t40 to the time t41 corresponds to, for example, the command value setting signal IGwB1 included in the discharge control signal. The energy application signal IGwB from the time t42 to the time t45 corresponds to, for example, the command value switching signal IGwB2 included in the discharge control signal.

The ignition apparatus 10B according to the third embodiment obtains the following benefits especially, which are different from the above benefits obtained in the first embodiment.

The controller 70 is configured to variably set, in the discharge control, i.e. the command value setting signal IGwB1, pulses respectively having widths in accordance with the respective command values C1 to C3. These pulse widths represent the respective command values C1 to C3. The controller 70 is also configured to change the level of the discharge control signal, i.e. the command value switching signal IGwB2, indicative of each of the change timings of the respective command values C1 to C3, to be different from the signal level of each pulse for representing the corresponding command value.

Determination of whether the energy application signal IGwB exceeds the threshold level THL therefore enables the energy application signal IGwB to be distinguished as the command value setting signal IGwB1 or the command value switching signal IGwB2.

Fourth Embodiment

Figure 12:
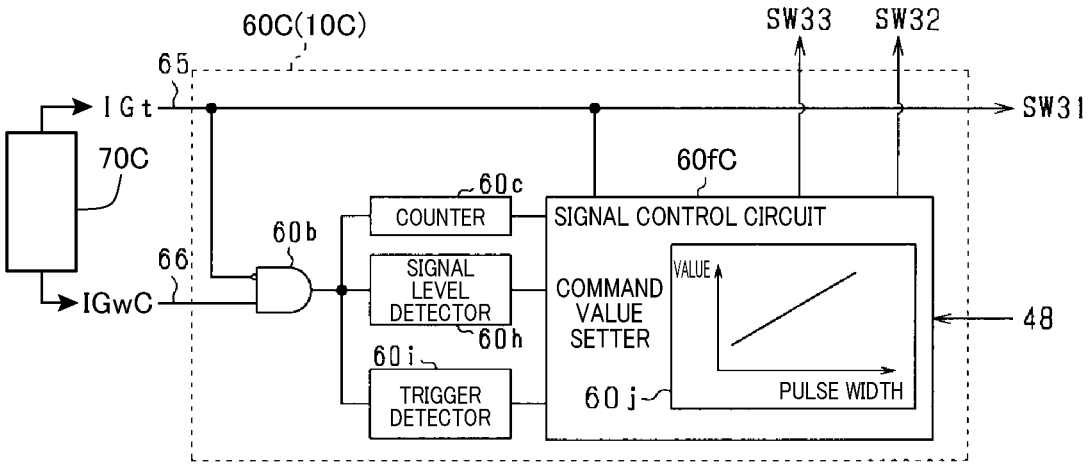
FIG. 12 is a block diagram schematically illustrating an example of the structure of a control circuit of an ignition apparatus according to the fourth embodiment of the present disclosure.
Figure 13:
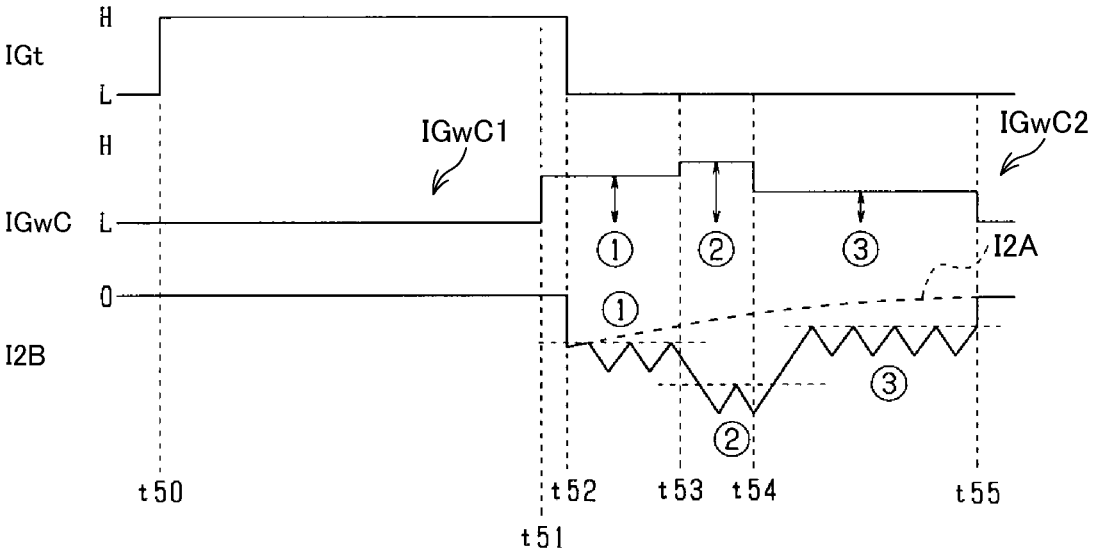
FIG. 13 is a joint timing chart schematically illustrating how the ignition apparatus illustrated in FIG. 12 is operated.

The following describes the fourth embodiment of the present disclosure with reference to FIGS. 12 and 13. The fourth embodiment differs from the second embodiment in the following points. So, the following mainly describes the different points.

The ignition apparatus 10C according to the fourth embodiment is configured such that the structure of a control circuit 60C is partly different from the structure of the control circuit 60A according to the second embodiment, and the energy application signal IGwC including the command value setting signal IGwC1 and the command value switching signal IGwC2 is different from the energy application signal IGwA according to the second embodiment.

FIG. 12 schematically illustrates an example of the structure of the control circuit 60C.

Referring to FIG. 12, as compared with the control circuit 60A, the logical AND gate 60*a* has been eliminated from the control circuit 60C. Specifically, the logical AND gate 60*b* calculates a logical AND between the inversion signal of the main ignition signal IGt input thereto via the first signal line 65 and the energy application signal IGwC input thereto via the second signal line 66 to thereby output a second output signal to the counter 60*c*, the signal level detector 60*h*, and the trigger detector 60*i*.

The main ignition signal IGt, the number of pulses counted by the counter 60*c*, the signal levels detected by the signal level detector 60*h*, and the output of the trigger detector 60*i* are input to a signal control circuit 60*f*C.

The signal control circuit 60*f*C is configured to repeatedly change a present command value for the discharge current to a next command value each time the output of the trigger detector 60*i* becomes the high level, i.e. rises to the high level.

A controller 70C is configured to generate the energy application signal IGwC different from the energy application signal IGwA.

FIG. 13 schematically illustrates a timing chart representing how the control circuit 60C and the controller 70C illustrated in FIG. 12 are operated. Note that FIG. 13 illustrates (1) How a selected main ignition signal IGt for the target spark plug 80 input to the control circuit 60C is changed over time (2) How the energy application signal IGwC is changed over time (3) How the auxiliary secondary current (see reference character I2B in FIG. 13) is changed over time At time t50, when the main ignition signal IGt sent from the controller 70C to the control circuit 60C rises from the low level to the high level, the control circuit 60C turns on, i.e. closes, each of the switching elements 31 and 32 to thereby cause a primary current to flow from the battery 82 to the second coil portion 11 of the target ignition coil 20. Note that the controller 70C sets the sending timing of the main ignition signal IGt and the length of the high-level period of the main ignition signal IGt from the time t50 to time t51 in accordance with the engine parameters, measured by the sensors 100 set forth above.

At that time, the controller 70C stores information about change of the required current value over time; the required current value represents the value of the discharge current required to maintain a started discharge in the spark plug 80.

While the main ignition signal IGt is in the high level (see the period from the time t50 to the time t52), the controller 70C modulates, in for example the period from time t51 to the time t52, the energy application signal IGwC such that the signal IGwC includes a pulse, i.e. a signal level that is set variably depending on the command value C1; the signal level is located within the predetermined range including the command value C1 or the predetermined range including the command value C1 at its lower limit, in the energy application signal IGwC.

Because the main ignition signal IGt has the high level so that the inversion signal of the main ignition signal IGt has the low level, the product of the inversion signal of the main ignition signal IGt and the energy application signal IGwC during the period from the time t50 to the time t51 becomes the low level independently of the signal level SC1 (see FIG. 13). That is, because the product of the inversion signal of the main ignition signal IGt and the energy application signal IGwC, which has the low level, is input to the signal level detector 60*h*, the input value to the signal level detector 60*h* becomes the low level.

At the time t52, the controller 70C changes the high level of the main ignition signal IGt input to the control circuit 60C to the low level. At that time, the control circuit 60C turns off, i.e. opens, the switching element 31 in response to the low level of the main ignition signal IGt to thereby shut off the primary current from the battery 82 to the second coil portion 11*b* of the ignition coil 20. This causes a high voltage to be induced in the secondary coil 21 of the target ignition coil 20, and the high voltage causes a main discharge current to flow through the target spark plug 80 in the main discharge control (see a dashed curve I2A in FIG. 13).

This falling edge of the main discharge signal IGt from the high level to the low level is detected by the trigger detector 60*i*, so that the high level signal is output from the trigger detector 60*i*.

In response to the high level signal of the trigger detector 60*i* at the time t52 as a trigger, the signal control circuit 60*f*C adjusts the secondary current I2 flowing through the secondary coil 21 of the target ignition coil 20, through which the main discharge current is flowing across the spark gap of the target spark plug 8, to the command value C1 in the superimposition discharge control.

During the period from the time t52 to the time t53, the controller 70C maintains the signal level of the energy application signal IGwC at the signal level SC1 corresponding to the command value C1.

While the main ignition signal IGt is in the low level, that is, after the completion of the output of the discharge start signal, causes the energy application signal IGwC to have individual pulses, i.e. individual signal levels, SC2 and SC3, which are variably set depending on the respective command values C2 and C3, within the period from the time t53 to time t55. Each of the signal levels SC2 and SC3 is located within the predetermined range including the corresponding one of the command values C2 and C3 or the predetermined range including the corresponding one of the command values C3 and C3 at its lower limit.

During the duration of the main ignition signal IGt from the time t50 to the time t55, the counter 60*c* of the control circuit 60C counts the number of pulses, that is, three pulses in this example, input thereto from the logical AND gate 60*b*. The signal level detector 60*h* detects the signal levels SC1 to SC3 of the respective pulses input thereto from the logical AND gate 60*b*. The signal control circuit 60*f*C sets, based on the signal levels SC1 to SC3, the respective command values C1 to C3 for the secondary current, i.e. discharge current, I2 including the main secondary current I2A and the auxiliary secondary current I2B.

The controller 70C previously determines a change timing suitable for the command value C1 based on a predetermined time interval having elapsed since the time t52. In response to the change timing at the time t53, the signal control circuit 60*f*C changes the secondary current I2 from the command value C1 to the command value C2 in the superimposition discharge control in the same manner as the adjustment of the secondary current I2 to the command value C1. In addition, the signal control circuit 60*f*C changes the signal level of the energy application signal IGwC to raise it by a predetermined level at the time t53. This rising edge of the energy application signal IGwC from the low level to the high level is detected by the trigger detector 60*i*, so that the high level signal is output from the trigger detector 60*i*.

The controller 70C previously determines a change timing suitable for the command value C2 based on a predetermined time interval having elapsed since the time t53. In response to the change timing at the time t54, the signal control circuit 60*f*C changes the secondary current I2 from the command value C2 to the command value C3 in the superimposition discharge control in the same manner as the adjustment of the secondary current I2 to the command value C1. In addition, the signal control circuit 60*f*C causes the signal level of the energy application signal IGwC to fall from the high level to the low level at the change timing suitable for the command value C2 at time t54. This falling edge of the energy application signal IGwC from the high level to the low level is detected by the trigger detector 60*i*, so that the high level signal is output from the trigger detector 60*i*.

The controller 70C previously determines a change timing suitable for the command value C3 based on a predetermined time interval having elapsed since the time t54. Then, the controller 70C changes the energy application signal IGwC from the low level to the high level at the change timing suitable for the command value C3 at time t55. This rising edge of the energy application signal IGwC from the low level to the high level is detected by the trigger detector 60*i*, so that the high level signal is output from the trigger detector 60*i*. The signal control circuit 60*f*C changes the command value C3 for the secondary current I2 to zero, which corresponds to a command value C4, thus terminating the discharge in the target spark plug 80.

Note that the counter 60*c* can be eliminated from the control circuit 60C.

Note that the main ignition signal IGt having the high-level duration from the time t50 to the time t52 corresponds to, for example, the discharge start signal, and the energy application signal IGwC from the time t51 to the time t55 serves as, for example, both the command value setting signal IGwC1 and the command value switching signal IGwC2 included in the discharge control signal.

The ignition apparatus 10C according to the fourth embodiment obtains the following benefits especially, which are different from the above benefits obtained in the second embodiment.

The controller 70C is configured to modulate a part of the energy application signal IGwC, which is output from the controller 70C after the completion of the output of the discharge start signal, such that the part of the energy application signal 1GwC includes individual pulses, i.e. individual signal levels, that are set variably depending on the respective command values C2 and C3. This configuration enables the command values C2 and C3 to be transmitted from the controller 70C to the control circuit 60C after the completion of output of the main ignition signal IGt. In other words, this configuration enables the command values C2 and C3 for the secondary current I2 to be instructed to the control circuit 60C after start of the discharge in the main discharge control. This makes it possible to instruct the control circuit 60C about the command values C2 and C3 and their change timings in accordance with the combustion state of the air-fuel mixture ignited by the started discharge in the spark plug 80 based on the main discharge control; the combustion state of the air-fuel mixture can be measured by one of the sensors 100.

The controller 70C is configured to modulate a part of the energy application signal IGwC, which is output from the controller 70C after the completion of the output of the discharge start signal, such that the part of the energy application signal 1IGwC includes the command values C1 to C3 for the secondary current I2. That is, the controller 70C changes the levels of the part of the energy application signal IGwC in accordance with the respective command values C2 and C3, thus providing, to the control circuit 60C, instructing the command values C2 and C3 and their respective change timings. This therefore enables the command value C1 for the secondary current I2 to be changed to the command value C2 at the corresponding change timing, and thereafter the command value C2 to be changed to the command value C3 at the corresponding change timing after the completion of the output of the discharge start signal. This therefore makes it possible to change the secondary current I2 after the start of controlling the secondary current I2. In addition, the controller 70C is configured to transfer the command values C2 and C3 to the control circuit 60C after the completion of the main ignition signal IGt, making it possible to provide, to the control circuit 60C, the command values C2 and C3 after the start of the discharge. This enables the level of the secondary current I2 to follow the combustion state of the air-fuel mixture in real time.

The ignition apparatus 10C is configured such that the logical AND between the inversion of the main ignition signal IGt and the energy application signal IGwC is input to the signal level detector 60*h*. This prevents the command value for the secondary current I2 from being set to the command value C1 during the output of the main ignition signal IGt including the period from the time t51 to the time t52.

Fifth Embodiment

Figure 14:
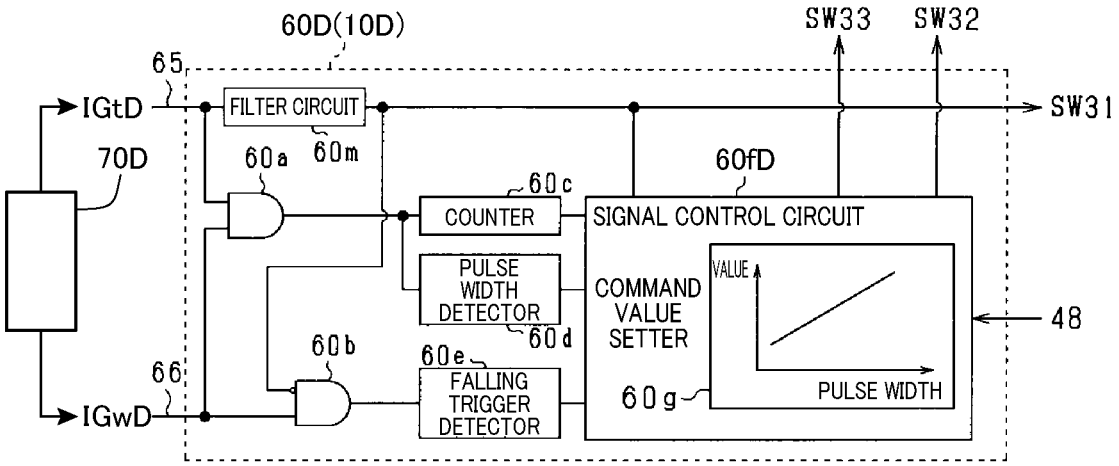
FIG. 14 is a block diagram schematically illustrating an example of the structure of a control circuit of an ignition apparatus according to the fifth embodiment of the present disclosure.
Figure 15:
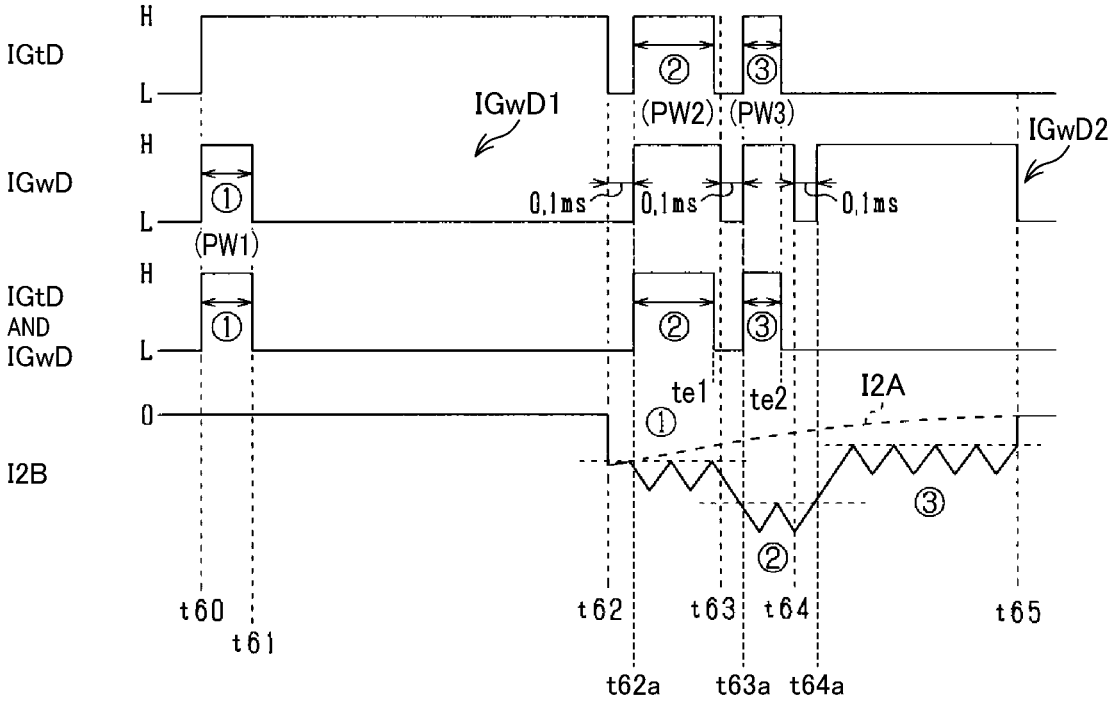
FIG. 15 is a joint timing chart schematically illustrating how the ignition apparatus illustrated in FIG. 14 is operated.

The following describes the fifth embodiment of the present disclosure with reference to FIGS. 14 and 15. The fifth embodiment differs from the first embodiment in the following points. So, the following mainly describes the different points.

The ignition apparatus 10D according to the fifth embodiment is configured such that (1) The structure of a control circuit 60D is partly different from the structure of the control circuit 60 according to the first embodiment (2) The main ignition signal IGtD is different from the main ignition signal IGt according to the first embodiment (3) The energy application signal IGwD including the command value setting signal IGwD1 and the command value switching signal IGwD2 is different from the energy application signal IGw according to the first embodiment FIG. 14 schematically illustrates an example of the structure of the control circuit 60D.

Referring to FIG. 14, the control circuit 60D is comprised of a filter circuit 60*m* in addition to the logical AND gate 60*a*, logical AND gate 60*b*, counter 60*c*, pulse width detector 60*d*, and falling trigger detector 60*e*. In addition, the control circuit 60D includes a signal control circuit 60*f*D different from the signal control circuit 60*f*.

The filter circuit 60*m* is configured to eliminate, from the main ignition signal IGtD input thereto via the first signal line 65, pulses having a cycle equal to or less than a predetermined threshold cycle, in other words, having a frequency equal to or more than a predetermined threshold frequency. The logical AND gate 60*b* is configured to calculate a logical AND between the main ignition signal IGtD, which has passed through the filter circuit 60*m*, and the energy application signal IGwD, and thereafter output the calculated logical AND to the falling trigger detector 60*e*.

The main ignition signal IGtD, which has passed through the filter circuit 60*m*, the number of pulses counted by the counter 60*c*, the pulse widths detected by the pulse width detector 60*d*, and the output of the falling trigger detector 60*e* are input to the signal control circuit 60*f*D.

The signal control circuit 60*f*D changes the present command value, such as the command value C1, for the secondary current I2, i.e. the discharge current, to the next command value, such as the command value C2, when the output of the falling trigger detector 60*e* is changed from the low level to the high level.

That is, the signal control circuit 60*f*D repeatedly changes the present command value for the discharge current to the next command value each time the output of the falling trigger detector 60*e* is changed from the low level to the high level.

A controller 70D is configured to generate the main ignition signal IGtD different from the main ignition signal IGt, and the energy application signal IGwD different from the energy application signal IGw, which will be described later.

FIG. 15 schematically illustrates a timing chart representing how the control circuit 60D and the controller 70D illustrated in FIG. 14 are operated. Note that FIG. 15 illustrates (1) How a selected main ignition signal IGtD for the target spark plug 80 input to the control circuit 60D is changed over time (2) How the energy application signal IGwD input to the control circuit 60D is changed over time (3) How the output of the logical AND gate 60*a*, which is the logical AND between the signals IGtD and IGwD, is changed over time (4) How the auxiliary secondary current (see reference character I2B in FIG. 15) is changed over time At time t60, when the main ignition signal IGtD sent from the controller 70D to the control circuit 60D rises from the low level to the high level, the control circuit 60D turns on, i.e. closes, each of the switching elements 31 and 32 to thereby cause a primary current to flow from the battery 82 to the second coil portion 11 of the target ignition coil 20. Note that the controller 70D sets the sending timing of the main ignition signal IGtD and the length of the high-level period of the main ignition signal IGtD from the time t60 to time t62 in accordance with the engine parameters, measured by the sensors 100 set forth above. In particular, the controller 70D sets the high-level width, i.e. high-level period, of the main ignition signal IGtD from the time t60 to the time t62 to a width that is enabled to pass through the filter circuit 60*m*.

At that time, the controller 70D stores information about change of the required current value over time; the required current value represents the value of the discharge current required to maintain a started discharge in the spark plug 80.

While the main ignition signal IGtD is in the high level (see the period from the time t60 to the time t62), the controller 70D modulates the energy application signal IGwD, i.e. the command value setting signal IGwD1, such that the signal IGwD includes a pulse with a width PW1 that is set variably depending on the command value C1 within for example the period from the time t60 to the time t61. Note that the controller 70D can adjust the command value setting signal IGwD1 at any point such that the command value setting signal IGwD1 has the pulse having the pulse width PW1.

At the time t62, the controller 70D changes the high level of the main ignition signal IGtD input to the control circuit 60D to the low level. At that time, the control circuit 60D turns off, i.e. opens, the switching element 31 in response to the low level of the main ignition signal IGtD to thereby shut off the primary current from the battery 82 to the second coil portion 11*b* of the ignition coil 20. This causes a high voltage to be induced in the secondary coil 21 of the target ignition coil 20, and the high voltage causes a main discharge current to flow through the target spark plug 80 in the main discharge control (see a dashed curve I2A in FIG. 15).

At the time t62, the signal control circuit 60*f*D adjusts the secondary current I2 flowing through the secondary coil 21 of the target ignition coil 20, through which the main discharge current is flowing across the spark gap of the target spark plug 8, to the command value C1 in the superimposition discharge control.

Specifically, the signal control circuit 60*f*D executes feedback control of on-off switching operations of the switching element 32 while maintaining the switching element 33 in the on state in the superimposition discharge control for adjusting the secondary current I2, which is measured based on the voltage across the current measurement resistor 48, to be within the predetermined range including the command value C1 or the predetermined range including the command value C1 at its lower limit.

After a predetermined time interval, for example, 0.1 ms has elapsed since changing of the main ignition signal IGtD to the low level, the control circuit 70D changes the main ignition signal IGtD and the energy application signal IGwD from the low level to the high level at time t62*a*.

After the completion of the output of the discharge start signal, which is a first part of the main ignition signal IGtD from the time t60 to the time t62, the controller 70D causes a second part of the main ignition signal IGtD, which follows the first part of the main ignition signal IGtD, to have individual pulses respectively having widths PW2 and PW3 that are variably set depending on the respective command values C2 and C3 during the period from the time t62 to the time t64.

In particular, the controller 70D sets the width, i.e. period, of the second part of the main ignition signal IGtD from the time t62 to the time t64 to a width that is disabled to pass through the filter circuit 60*m*.

In addition, the controller 70D sets the end timing te1, te2 of each of the pulse widths PW2 and PW3 of the second part of the main ignition signal IGtD to be earlier than the change timing (see time t63, t64) for the corresponding one of the command values C2 and C3.

In other words, a pulse width of the energy application signal IGwD from the time t62*a* to the end timing te1, which corresponds to the pulse width PW2, is for example slightly larger than the pulse width PW2. Similarly, a pulse width of the energy application signal IGwD from the time t63*a* to the end timing te2, which corresponds to the pulse width PW3, is for example slightly larger than the pulse width PW3.

During the period from the time t60 to the time t65, the counter 60*c* of the control circuit 60D counts the number of pulses included in the first output signal input thereto from the logical AND gate 60*a*. Because the logical AND between the second part of the main ignition signal IGtD and the energy application signal IGwD as the first output signal input thereto from the logical AND gate 60*a* becomes the low level, the counter 60*c* counts thee pulses included in the first output signal input thereto from the logical AND gate 60*a*. The pulse width detector 60*d* detects the pulse widths PW1 to PW3 of the respective pulses included in the first output signal input thereto from the logical AND gate 60*a*.

Then, the signal control circuit 60*f*D sets, based on the pulse widths PW1 to PW3, the respective command values C1 to C3 for the secondary current, i.e. discharge current, 12 including the main secondary current I2A and the auxiliary secondary current I2B.

At the time t63, the controller 70D causes the energy application signal IGwD to fall from the high level to the low level. This enables the falling trigger detector 60*e* to output the high level signal. In response to the output of the high level signal as a trigger, the signal control circuit 60*f*D changes the secondary current I2 from the command value C1 to the command value C2 in the superimposition discharge control in the same manner as the adjustment of the secondary current I2 to the command value C1.

Specifically, the signal control circuit 60*f*D closes the switching element 32 when the secondary current measured based on the voltage across the current measurement resistance 48 becomes below the command value C2, which represents, for example, lower limit of the range. This enables the auxiliary secondary current based on the primary current flowing through the first coil portion 11*a* to be superimposed on the discharge current based on the main discharge mode, resulting in an increase of the discharge current flowing across the spark gap of the spark plug 80.

After a predetermined time interval, for example, 0.1 ms has elapsed since falling of the energy application signal IGwD at the time t63, the control circuit 70D changes the main ignition signal IGtD and the energy application signal IGwD from the low level to the high level at time t63*a*.

Similarly at the time t64, the controller 70D causes the energy application signal IGwD to fall from the high level to the low level. This enables the falling trigger detector 60*e* to output the high level signal. In response to the output of the high level signal as a trigger, the signal control circuit 60*f*D changes the secondary current I2 from the command value C2 to the command value C3 in the superimposition discharge control in the same manner as the adjustment of the secondary current I2 to the command value C1.

After a predetermined time interval, for example, 0.1 ms has elapsed since falling of the energy application signal IGwD at the time t64, the control circuit 70D changes the energy application signal IGwD from the low level to the high level at time t64*a*.

At the time t65, the controller 70D causes the energy application signal IGwD to fall from the high level to the low level. This enables the falling trigger detector 60*e* to output the high level signal.

In response to the output of the high level signal as a trigger, because the number of command values that have been adjusted by the control circuit 60D has reached the number of pulses counted by the counter 60*c*, the control circuit 60D terminates the discharge in the target spark plug 80.

Note that the first part of the main ignition signal IGtD having the high-level duration from the time t60 to the time t62 corresponds to, for example, the discharge start signal, and the second part of the main ignition signal IGtD from the time t62 to the time t64 corresponds to, for example, the command value setting signal included in the discharge control signal. The energy application signal IGwD from the time t60 to the time t61 corresponds to, for example, the command value setting signal IGwD1 included in the discharge control signal, and the energy application signal IGwD from the time t62 to the time t65 corresponds to, for example, the command value switching signal IGwD2 included in the discharge control signal.

The ignition apparatus 10D according to the fifth embodiment obtains the following benefits especially, which are different from the above benefits obtained in the second embodiment.

The controller 70D is configured to modulate the energy application signal IGwD output therefrom during the discharge start signal being output therefrom from the time t60 to the time t62 such that the signal IGwD includes a pulse with the pulse width PW1 that is variably set depending on the corresponding command value C1. This enables the command value C1 to be transferred from the controller 70D to the control circuit 60D while the discharge start signal included in the main ignition signal IGt is being transferred from the controller 70D to the control circuit 60D.

The controller 70D is also configured to modulate the second part of the main ignition signal IGtD within the period from the time t62 to the time t64, which is output after the completion of the output of the discharge start signal, such that the second part of the main ignition signal IGtD includes pulses with the respective pulse widths PW2 and PW3 that are variably set depending on the corresponding command values C2 and C3. This enables the command values C2 and C3 to be transferred from the controller 70D to the control circuit 60D after the completion of the output of the discharge start signal.

This therefore makes it possible to change the secondary current I2 after the start of controlling the secondary current I2. In addition, the controller 70D is configured to transfer the command values C2 and C3 to the control circuit 60D after the completion of the main ignition signal IGtD, making it possible to instruct the control circuit 60D about the command values C2 and C3 after the start of the discharge. This enables the level of the secondary current I2 to follow the combustion state of the air-fuel mixture in real time.

Note that the control circuit 60D is configured to control the discharge in the spark plug 80 in accordance with the logical AND between the main ignition signal IGtD and the energy application signal IGwD. This configuration enables the pulse widths PW2 and PW3 of the main ignition signal IGtD and the corresponding pulse widths of the energy application signal IGwD, which are output after the completion of the output of the discharge start signal, to be freely set. Making the pulse width of the energy application signal IGwD, which corresponds to the pulse width PW2 based on the command value C2, shorter than the pulse width PW2 enables the discharge current to be adjusted to a value lower than the command value C2. Similarly, making the pulse width of the energy application signal IGwD, which corresponds to the pulse width PW3 based on the command value C3, shorter than the pulse width PW3 enables the discharge current to be adjusted to a value lower than the command value C3.

The ignition apparatus 10D is configured such that the discharge control signal including the command value setting signal and the command value switching signal is transferred via the first and second signal lines 65 and 66. Making the logical AND between the main ignition signal IGtD on which one of the command value setting signal and the command value switching signal is superimposed and the energy application signal IGwD on which the other of the command value setting signal and the command value switching signal is superimposed enables flexibility of adjustment of the command values for the discharge current during the discharge to be improved, resulting in a further improvement of the followability of the discharge current with respect to the combustion state of the air-fuel mixture.

Sixth Embodiment

Figure 16:
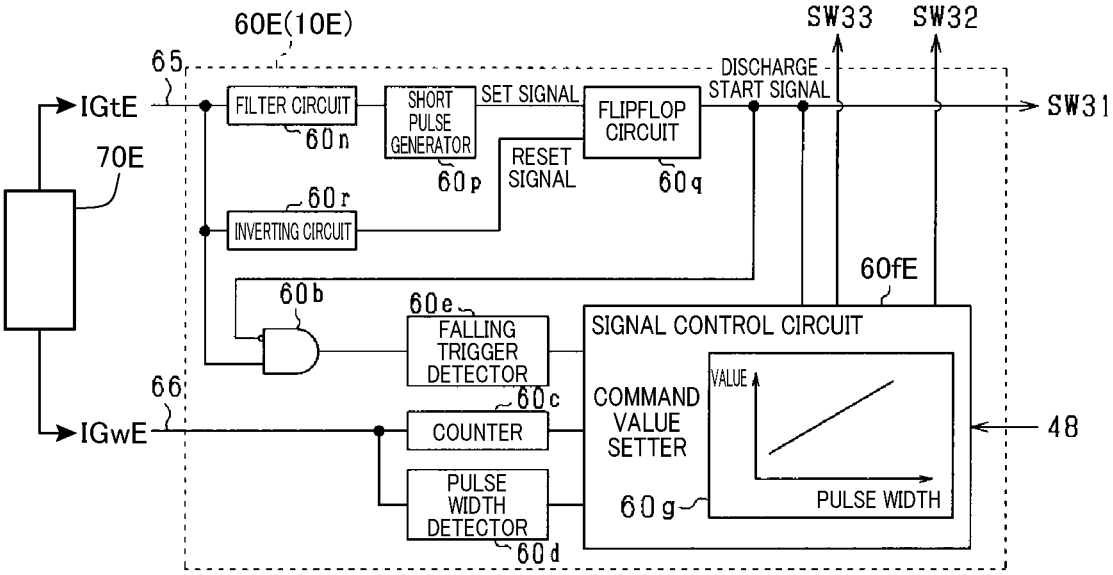
FIG. 16 is a block diagram schematically illustrating an example of the structure of a control circuit of an ignition apparatus according to the sixth embodiment of the present disclosure.
Figure 17:
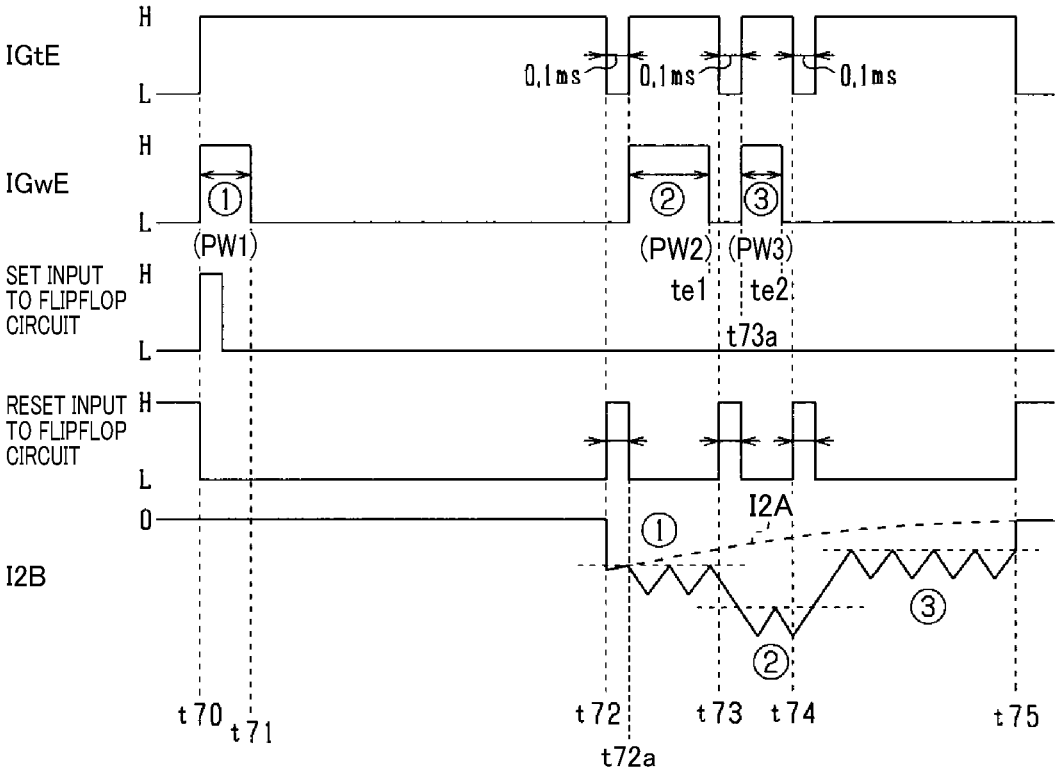
FIG. 17 is a joint timing chart schematically illustrating how the ignition apparatus illustrated in FIG. 16 is operated.

The following describes the sixth embodiment of the present disclosure with reference to FIGS. 16 and 17. The sixth embodiment differs from the fifth embodiment in the following points. So, the following mainly describes the different points.

The ignition apparatus 10E according to the sixth embodiment is configured such that (1) The structure of a control circuit 60E is partly different from the structure of the control circuit 60D according to the fifth embodiment (2) The main ignition signal IGtE is different from the main ignition signal IGtD according to the fifth embodiment (3) The energy application signal IGwE including the command value setting signal IGwE1 and the command value switching signal IGwE2 is different from the energy application signal IGwD according to the fifth embodiment FIG. 16 schematically illustrates an example of the structure of the control circuit 60E.

Referring to FIG. 16, the control circuit 60E is comprised of a filter circuit 60*n*, a short pulse generator 60*p*, a flipflop circuit 60*q*, and an inverting circuit 60*r* in addition to the logical AND gate 60*b*, counter 60*c*, pulse width detector 60*d*, and falling trigger detector 60*e*. In addition, the control circuit 60D includes a signal control circuit 60*f*E different from the signal control circuit 60*f*D.

The filter circuit 60*n* is configured to eliminate, from the main ignition signal IGtE input thereto via the first signal line 65, low-level pulses having a cycle equal to or less than a predetermined threshold cycle, in other words, having a frequency equal to or more than a predetermined threshold frequency.

The short pulse generator 60*p* is configured to generate a short pulse having a predetermined width each time the main ignition signal IGtE, which has passed through the filter circuit 60*n*, rises.

The inversion circuit 60*r* is configured to invert the main ignition signal IGtE input thereto via the first signal line 65, and output an inversion signal of the main ignition signal IGtE.

The flipflop circuit 60*q* is configured to receive the output of the short pulse generator 60*p* as its set input, and receive the output of the inversion circuit 60*r* as its reset input. The flip-flop circuit 60*q* is configured to (1) Store previous output information upon each of the set input and the reset input being the low level (2) Output the low level signal upon the set input having the low level and the reset input having the high level (3) Output the high level signal upon the set input having the high level and the reset input having the low level The output of the flipflop circuit 60*q* is input to both the switching element 31 and the logical AND gate 60*b*.

The logical AND gate 60*b* is configured to calculate the logical AND between the inversion signal of the output of the flipflop circuit 60*q* and the main ignition signal IGtE, and send an output signal to the falling trigger detector 60*e*. To the counter 60*c* and the pulse width detector 60*d*, the energy application signal IGwE is input.

The output of the flipflop circuit 60*q*, the number of pulses counted by the counter 60*c*, the pulse widths detected by the pulse width detector 60*d*, and the output of the falling trigger detector 60*e* are input to the signal control circuit 60*f*E.

The signal control circuit 60*f*E changes the present command value, such as the command value C1, for the secondary current I2, i.e. the discharge current, to the next command value, such as the command value C2, when the output of the falling trigger detector 60*e* is changed from the low level to the high level.

That is, the signal control circuit 60*f*E repeatedly changes the present command value for the discharge current to the next command value each time the output of the falling trigger detector 60*e* is changed from the low level to the high level.

A controller 70E is configured to generate the main ignition signal IGtE different from the main ignition signal IGtD, and the energy application signal IGwE different from the energy application signal IGwD, which will be described later.

FIG. 17 schematically illustrates a timing chart representing how the control circuit 60E and the controller 70E illustrated in FIG. 16 are operated. Note that FIG. 17 illustrates (1) How a selected main ignition signal IGtE for the target spark plug 80 input to the control circuit 60E is changed over time (2) How the energy application signal IGwE input to the control circuit 60E is changed over time (3) How the set input to the flipflop circuit 60*q* is changed over time (4) How the reset input to the flipflop circuit 60*q* is changed over time (5) How the auxiliary secondary current (see reference character I2B in FIG. 17) is changed At time t70, when the main ignition signal IGtE sent from the controller 70E to the control circuit 60E rises from the low level to the high level, the control circuit 60E turns on, i.e. closes, each of the switching elements 31 and 32 to thereby cause a primary current to flow from the battery 82 to the second coil portion 11 of the target ignition coil 20. Note that the controller 70E sets the sending timing of the main ignition signal IGtE and the length of the high-level period of the main ignition signal IGtE from the time t70 to time t72 in accordance with the engine parameters, measured by the sensors 100 set forth above.

At that time, the controller 70E stores information about change of the required current value over time; the required current value represents the value of the discharge current required to maintain a started discharge in the spark plug 80.

While the main ignition signal IGtE is in the high level (see the period from the time t70 to the time t72), the controller 70E modulates the energy application signal IGwE, i.e. the command value setting signal, such that the signal IGwE includes a pulse with a width PW1 that is set variably depending on the command value C1 within for example the period from the time t70 to the time t71. Note that the controller 70E can adjust the command value setting signal IGwE1 at any point such that the command value setting signal IGwE1 has the pulse having the pulse width PW1.

At the time t72, the controller 70E changes the high level of the main ignition signal IGtE input to the control circuit 60E to the low level. At that time, the control circuit 60E turns off, i.e. opens, the switching element 31 in response to the low level of the main ignition signal IGtE to thereby shut off the primary current from the battery 82 to the second coil portion 11*b* of the ignition coil 20. This causes a high voltage to be induced in the secondary coil 21 of the target ignition coil 20, and the high voltage causes a main discharge current to flow through the target spark plug 80 in the main discharge control (see a dashed curve I2A in FIG. 17).

At the time t72, the signal control circuit 60*f*E adjusts the secondary current I2 flowing through the secondary coil 21 of the target ignition coil 20, through which the main discharge current is flowing across the spark gap of the target spark plug 8, to the command value C1 in the superimposition discharge control.

Specifically, the signal control circuit 70*f*E executes feedback control of on-off switching operations of the switching element 32 while maintaining the switching element 33 in the on state in the superimposition discharge control for adjusting the secondary current I2, which is measured based on the voltage across the current measurement resistor 48, to be within the predetermined range including the command value C1 or the predetermined range including the command value C1 at its lower limit.

After a predetermined time interval, for example, 0.1 ms has elapsed since changing of the main ignition signal IGtE to the low level, the control circuit 70E changes the main ignition signal IGtE and the energy application signal IGwE from the low level to the high level at time t72*a*.

In particular, the controller 70E sets the width, i.e. period, of each of the low level pulses in the main ignition signal IGtE after the time t72 to a width that is disabled to pass through the filter circuit 70*n*. Note that the output of the flipflop circuit 60*q* represents only the discharge start signal, which a first part of the main ignition signal IGtE between the time t70 and the time t72.

After the completion of the output of the discharge start signal, which is the first part of the main ignition signal IGtE from the time t70 to the time t72, the controller 70E causes the energy application signal IGwE, which follows the first part of the main ignition signal IGtE, to have individual pulses respectively having widths PW2 and PW3 that are variably set depending on the respective command values C2 and C3 during the period from the time t72 to the time t74.

In addition, the controller 70E sets the end timing te1, te2 of each of the pulse widths PW2 and PW3 of the energy application signal IGwE to be earlier than the change timing (see time t73, t74) for the corresponding one of the command values C2 and C3.

During the period from the time t70 to the time t75, the counter 60*c* of the control circuit 60E counts the number of pulses included in the energy application signal IGwE input thereto via the second signal line 66. At that time, the counter 60*c* counts three pulses included in the energy application signal IGwE. The pulse width detector 60*d* detects the pulse widths PW1 to PW3 of the respective pulses included in the energy application signal IGwE.

Then, the signal control circuit 60*f*E sets, based on the pulse widths PW1 to PW3, the respective command values C1 to C3 for the secondary current, i.e. discharge current, I2 including the main secondary current I2A and the auxiliary secondary current I2B.

At the time t73, the controller 70E causes the main ignition signal IGtE to fall from the high level to the low level. That is, the controller 70E changes the level of the main ignition signal IGtE at a corresponding command-value change timing. This enables the falling trigger detector 60*e* to output the high level signal. In response to the output of the high level signal as a trigger, the signal control circuit 60*f*E changes the secondary current I2 from the command value C1 to the command value C2 in the superimposition discharge control in the same manner as the adjustment of the secondary current I2 to the command value C1.

After a predetermined time interval, for example, 0.1 ms has elapsed since falling of the main ignition signal IGtE at the time t73, the control circuit 70E changes the main ignition signal IGtE from the low level to the high level at time t73*a*.

Similarly at the time t74, the controller 70E causes the main ignition signal IGtE to fall from the high level to the low level. This enables the falling trigger detector 60*e* to output the high level signal. In response to the output of the high level signal as a trigger, the signal control circuit 60*f*E changes the secondary current I2 from the command value C2 to the command value C3 in the superimposition discharge control in the same manner as the adjustment of the secondary current I2 to the command value C1.

After a predetermined time interval, for example, 0.1 ms has elapsed since falling of the main ignition signal IGtE at the time t74, the control circuit 70E changes the main ignition signal IGtE from the low level to the high level at time t74*a*.

At the time t75, the controller 70E causes the main ignition signal IGtE to fall from the high level to the low level. This enables the falling trigger detector 60*e* to output the high level signal.

In response to the output of the high level signal as a trigger, because the number of command values that have been adjusted by the control circuit 60E has reached the number of pulses counted by the counter 60*c*, the control circuit 60E terminates the discharge in the target spark plug 80.

Note that the first part of the main ignition signal IGtE having the high-level duration from the time t70 to the time t72 corresponds to, for example, the discharge start signal, and the second part of the main ignition signal IGtE from the time t72 to the time t75 corresponds to, for example, the command value setting signal included in the discharge control signal. The energy application signal IGwE from the time t70 to the time t71 and the time t72 to the time t74 corresponds to, for example, the command value setting signal IGwD1 included in the discharge control signal, and the energy application signal included in the discharge control signal.

The ignition apparatus 10E according to the sixth embodiment obtains the following benefits especially, which are different from the above benefits obtained in the fifth embodiment.

The controller 70E is configured to modulate the second part of the main ignition signal IGtE within the period from the time t72 to the time t74, which is output after the completion of the output of the discharge start signal, such that the second part of the main ignition signal IGtE includes pulses with the respective pulse widths PW2 and PW3 that are variably set depending on the corresponding command values C2 and C3. This enables the command values C2 and C3 to be transferred from the controller 70E to the control circuit 60E after the completion of the output of the discharge start signal.

This therefore makes it possible to change the secondary current I2 after the start of controlling the secondary current I2. In addition, the controller 70E is configured to transfer the command values C2 and C3 to the control circuit 60E after the completion of the main ignition signal IGtE, making it possible to provide, to the control circuit 60E, the command values C2 and C3 after the start of the discharge. This enables the level of the secondary current I2 to follow the latest combustion state of the air-fuel mixture.

Seventh Embodiment

Figure 18:
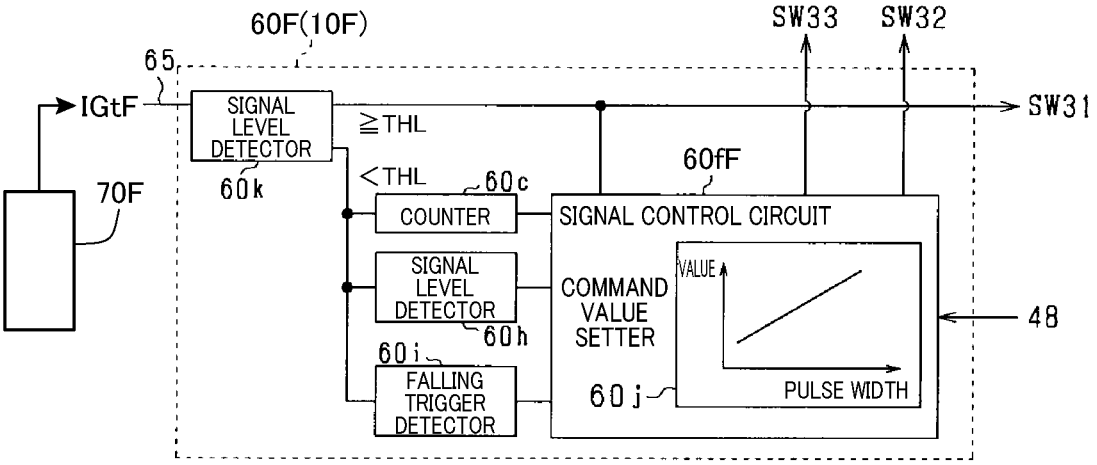
FIG. 18 is a block diagram schematically illustrating an example of the structure of a control circuit of an ignition apparatus according to the seventh embodiment of the present disclosure.
Figure 19:
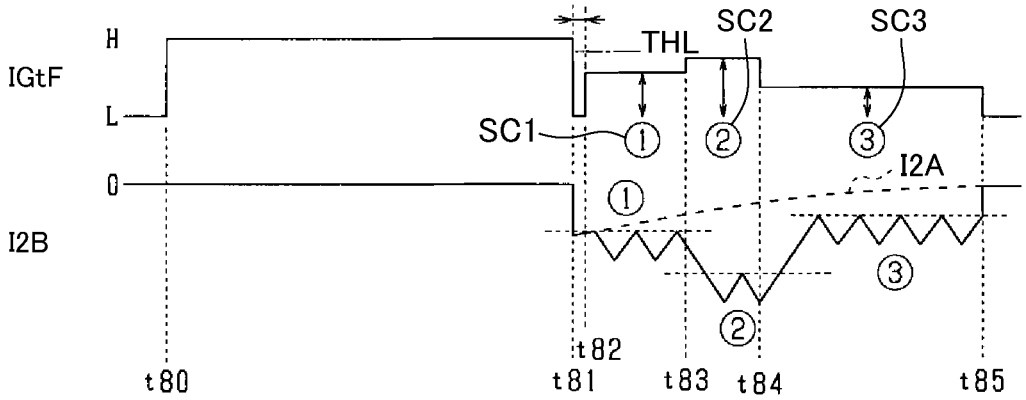
FIG. 19 is a joint timing chart schematically illustrating how the ignition apparatus illustrated in FIG. 18 is operated.
Figure 20:
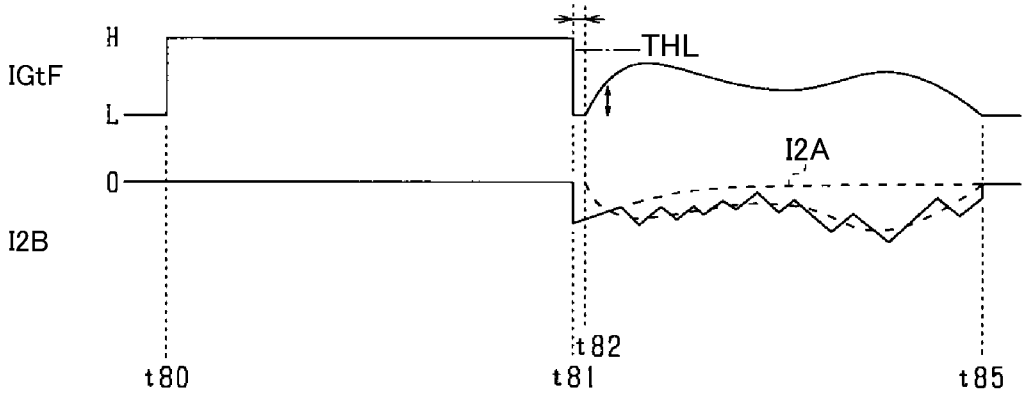
FIG. 20 is a joint timing chart schematically illustrating how an ignition apparatus according to a second modification is operated.

The following describes the seventh embodiment of the present disclosure with reference to FIGS. 18 to 20. The seventh embodiment differs from the fourth embodiment in the following points. So, the following mainly describes the different points.

The ignition apparatus 10F according to the seventh embodiment is configured such that the structure of a control circuit 60F is partly different from the structure of the control circuit 60C according to the fourth embodiment, and the main ignition signal IGtF is different from the main ignition signal IGt according to the fourth embodiment. Note that, in the seventh embodiment, no second signal line 66 is provided between a controller 70F and the control circuit 60F, so that the controller 70F is configured not to output the energy application signal IGw.

FIG. 18 schematically illustrates an example of the structure of the control circuit 60F.

Referring to FIG. 18, as compared with the control circuit 60C, the logical AND gate 60*b* has been eliminated from the control circuit 60F. IN addition, the control circuit 60F includes a signal level detector 60*k* as described in the third embodiment.

Specifically, the signal level detector 60*k* detects the signal level, i.e. the voltage level, of each pulse included in the main ignition signal IGtF input thereto from the controller 70F via the first signal line 65. Specifically, the signal level detector 60*k* detects the signal level of the main ignition signal IGtF except for the low level, i.e. zero level.

Then, the signal level detector 60*k* outputs, to the switching element 31, at least one pulse upon the level of the at least one pulse is equal to or higher than the threshold level THL. The signal level detector 60*k* also outputs, to the counter 60*c*, the pulse width detector 60*d*, and the trigger detector 60*i*, at least one pulse upon the level of the at least one pulse is lower than the threshold level THL.

The pulses whose levels are equal to or higher than the threshold level THL, which are detected by the signal level detector 60*k*, the number of pulses counted by the counter 60*c*, the signal levels detected by the signal level detector 60*h*, and the output of the trigger detector 60*i* are input to a signal control circuit 60*f*F.

The signal control circuit 60*f*F is configured to repeatedly change a present command value for the discharge current to a next command value each time the output of the trigger detector 60*i* becomes the high level, i.e. rises to the high level.

The controller 70F is configured to generate the main ignition signal IGtF different from the main ignition signal IGt.

FIG. 19 schematically illustrates a timing chart representing how the control circuit 60F and the controller 70F illustrated in FIG. 18 are operated. Note that FIG. 19 illustrates (1) How a selected main ignition signal IGtF for the target spark plug 80 input to the control circuit 60F is changed over time (2) How the auxiliary secondary current (see reference character I2B in FIG. 19) is changed over time At time t80, when the main ignition signal IGtF sent from the controller 70F to the control circuit 60F rises from the low level to the high level, the control circuit 60F turns on, i.e. closes, each of the switching elements 31 and 32 to thereby cause a primary current to flow from the battery 82 to the second coil portion 11 of the target ignition coil 20. Note that the controller 70F sets the sending timing of the main ignition signal IGtF and the length of the high-level period of the main ignition signal IGtF from the time t80 to time t81 in accordance with the engine parameters, measured by the sensors 100 set forth above. In addition, the controller 70F sets the level of a first part of the main ignition signal IGtF between the time t80 to the time t81 to be higher than the threshold level THL.

At the time t81, the controller 70F changes the high level of the main ignition signal IGtF input to the control circuit 60F to the low level. At that time, the control circuit 60F turns off, i.e. opens, the switching element 31 in response to the low level of the main ignition signal IGtF to thereby shut off the primary current from the battery 82 to the second coil portion 11*b* of the ignition coil 20. This causes a high voltage to be induced in the secondary coil 21 of the target ignition coil 20, and the high voltage causes a main discharge current to flow through the target spark plug 80 in the main discharge control (see a dashed curve I2A in FIG. 19). After setting the main ignition signal IGtF to the low level, the controller 70F maintains the main ignition signal IGf at the low level for a predetermined period, such as 0.05 ms.

During the period from the time t82 to the time t85, the controller 70F modulates the main ignition signal IGtF such that the signal IGtF includes individual pulses, i.e. individual signal levels, SC1 to SC3, which are variably set depending on the respective command values C1 to C3. In addition, the controller 70F sets the signal level of each of the pulses SC1 to SC3 to be lower than the threshold level THL.

During the period from the time t80 to the time t85, the counter 60*c* of the control circuit 60F counts the number of pulses, whose levels are lower than the threshold level THL, input thereto from the signal level detector 60*k*. The signal level detector 60*h* detects the signal levels SC1 to SC3 of the respective pulses, whose levels are lower than the threshold level THL, input thereto from the signal level detector 60*k*. The signal control circuit 60*f*F sets, based on the signal levels SC1 to SC3, the respective command values C1 to C3 for the secondary current, i.e. discharge current, I2 including the main secondary current I2A and the auxiliary secondary current I2B.

At the time t82, the controller 70F changes the main ignition signal IGtF input to the control circuit 60F from the low level to the signal level SC1. That is, the controller 70F changes the signal level of the main ignition signal IGtF at a corresponding command-value change timing. This enables the trigger detector 60*i* to output the high level signal. In response to the output of the high level signal as a trigger, the signal control circuit 60*f*F feedback controls, to the command value C1, the secondary current on which the auxiliary secondary current based on the primary current flowing through the first coil portion 11*a* and the discharge current based on the main discharge control are superimposed.

At the time t83, the controller 70F changes the main ignition signal IGtF input to the control circuit 60F from the signal level SC1 to the signal level SC2. That is, the controller 70F changes the signal level of the main ignition signal IGtF at a corresponding command-value change timing. This enables the trigger detector 60*i* to output the high level signal. In response to the output of the high level signal as a trigger, the signal control circuit 60*f*F changes the secondary current I2 from the command value C1 to the command value C2 in the superimposition discharge control in the same manner as the adjustment of the secondary current I2 to the command value C1.

At the time t84, the controller 70F changes the main ignition signal IGtF input to the control circuit 60F from the signal level SC2 to the signal level SC3. That is, the controller 70F changes the signal level of the main ignition signal IGtF at a corresponding command-value change timing. This enables the trigger detector 60*i* to output the high level signal. In response to the output of the high level signal as a trigger, the signal control circuit 60*f*F changes the secondary current I2 from the command value C2 to the command value C3 in the superimposition discharge control in the same manner as the adjustment of the secondary current I2 to the command value C1.

At the time t85, the controller 70F changes the main ignition signal IGtF from the high level to the low level at the change timing suitable for the command value C3 at time t85. This falling edge of the main ignition signal IGtF from the high level to the low level is detected by the trigger detector 60*i*, so that the high level signal is output from the trigger detector 60*i*. The signal control circuit 60*f*F changes the command value C3 for the secondary current I2 to zero, which corresponds to a command value C4, thus terminating the discharge in the target spark plug 80.

Note that the first part of the main ignition signal IGtF having the high-level duration from the time t80 to the time t81 corresponds to, for example, the discharge start signal, and the second part of the main ignition signal IGtF from the time t82 to the time t85 corresponds to, for example, the command value setting signal and command value switching signal as the discharge control signal.

The ignition apparatus 10F according to the seventh embodiment obtains the following benefits especially, which are different from the above benefits obtained in the fourth embodiment.

The controller 70F is configured to modulate the second part of the main ignition signal IGtF after the completion of the output of the discharge start signal, such that the second part of the main ignition signal IGtF includes individual pulses, i.e. individual signal levels, that are set variably depending on the respective command values C1 to C3. In particular, the controller 70F changes the signal levels SC1 to SC3 of the pulses of the main ignition signal IGtF to be matched with the respective command values C1 to C3 at the respective change timings suitable for the command values C1 to C3.

This configuration enables the secondary current I2 to be adjusted after start of controlling the secondary current I2. In addition, this configuration enables the command values C1 to C3 for the secondary current I2 to be instructed to the control circuit 60F after the completion of the output of the discharge start signal. This makes it possible to instruct the control circuit 60F to change the secondary current I2 to the command values C1 to C3 immediately after start of controlling the discharge current.

Determination of whether the signal level of the main ignition signal IGtF exceeds the threshold level THL enables the discharge start signal, which is the first part of the main ignition signal IGtF, and the discharge control signal, which is the second part of the main ignition signal IGtF, to be distinguished from each other.

Note that the ignition apparatus 10F according to the seventh embodiment can be modified as follows. Like parts between the seventh embodiment and its first and second modification, to which like reference characters are assigned, are omitted or simplified to avoid redundant description.

The signal level detector 60*k* according to the first modification is configured to output, to the switching element 31 and the signal control circuit 60*f*F, at least one pulse upon the level of the at least one pulse is lower than the threshold level THL. The signal level detector 60*k* is also configured to output, to the counter 60*c*, the pulse width detector 60*d*, and the trigger detector 60*i*, at least one pulse upon the level of the at least one pulse is equal to or higher than the threshold level THL.

The controller 70F is configured to generate the main ignition signal IGtF such that (1) The signal level of the first part of the main ignition signal IGtF, which serves as the discharge start signal, is set to be lower than the threshold level THL (2) The signal level of the second part of the main ignition signal IGtF, which serves as the discharge control signal, is set to be equal to or higher than the threshold level THL This configuration obtains benefits similar to the benefits obtained by the seventh embodiment.

Referring to FIG. 20, during the period from the time t82 to the time t85, the controller 70F according to the second modification modulates the main ignition signal IGtF, which serves as both the command value setting signal and the command value switching signal, such that (1) The signal level of the main ignition signal IGtF varies depending on continuously changed command values (2) The variation timings of the main ignition signal IGtF correspond to the respective continuous change timings of the continuously changed command levels This enables the trigger detector 60*i* to output the high level signal. In response to the output of the high level signal as a trigger, the signal control circuit 60*f*F feedback controls the secondary current I2 to the continuous command values. This configuration enables the variation timings of the main ignition signal IGtF serving as the discharge control signal, to be instructed to the control circuit 60F as the continuous change timings of the continuously changed command levels. This therefore enables the change timings of the command values to be flexibly instructed to the control circuit 60F in real time. Note that the second modification can be applied to the energy application signal IGwC of the fourth embodiment.

Modifications

The present disclosure is not limited to the descriptions of each of the first to seventh embodiments, and the descriptions of each of the first to seventh embodiments can be widely modified within the scope of the present disclosure. Like parts between each embodiment and its modifications, to which like reference characters are assigned, are omitted or simplified to avoid redundant description.

Each of the controllers 70 and 70A to 70F is configured to set the pulse widths or the signal levels in the corresponding energy application signal so as to be proportional to the respective command values, but the present disclosure is not limited to this configuration.

Specifically, each of the controllers 70 and 70A to 70F can be configured to set the pulse widths or the signal levels in the corresponding energy application signal so as to be inversely proportional to the respective command values. In this modification, each of the signal control circuits 60*f* and 60*f*A to 60*f*F can be configured to set each of the command values for the secondary current I2 to be inversely proportional to the corresponding one of the pulse widths or the corresponding one of the signal levels.

Each of the controllers 70 and 70A to 70F can be configured to modulate the discharge control signal such that the discharge control signal includes at least one of a pulse width and a signal level for each command value that is set variably depending on the corresponding one of the command levels.

Figure 21:
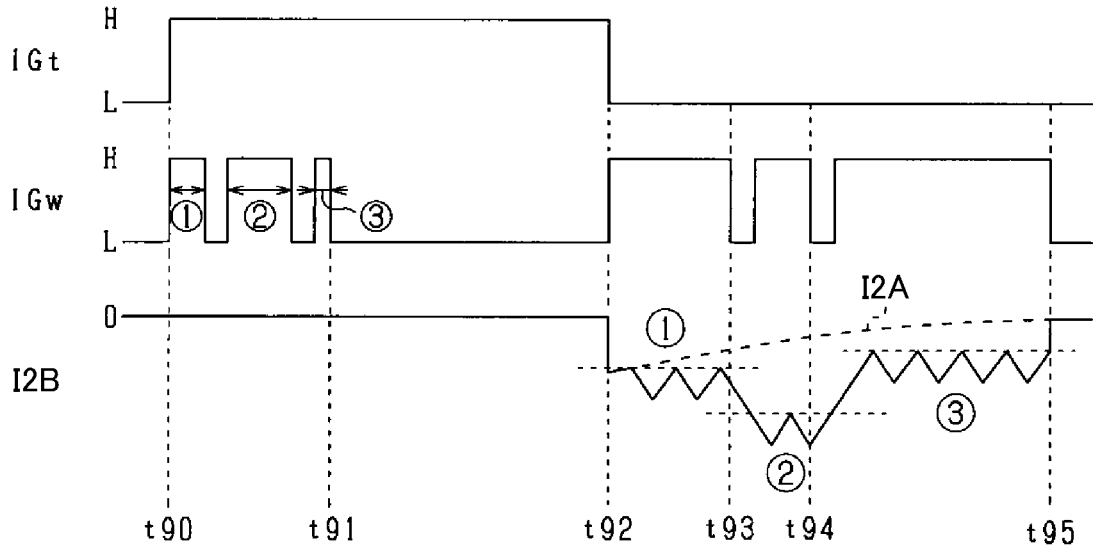
FIG. 21 is a joint timing chart schematically illustrating how an ignition apparatus according to a modification of the first embodiment is operated.

FIG. 21 schematically illustrates an example where the ignition apparatus 10 according to the first embodiment is modified based on the subject matter of this modification.

Referring to FIG. 21, while the main ignition signal IGt is in the high level (see the period from the time t90 to the time t92), the controller 70 modulates, in for example the period from the time t90 to time t91, the energy application signal IGw such that the signal IGw includes individual pulses respectively having widths PW1 to PW3 that are determined relative to a reference width corresponding to a reference command value. For example, the controller 70 determines the pulse width PW1 corresponding to the command value C1 as the reference width, and determines, based on a comparison and/or a difference between the command value C1 and each of the command values C2 and C3, the corresponding one of the pulse widths PW2 and PW3 relative to the reference pulse width PW1.

At the time t92, the controller 70 adjusts the command value for the secondary current I2 to the command value C1, and adjusts the command value for the secondary current I2 to each of the command values C2 and C3 at the corresponding one of times t93 and t94 in accordance with a comparison and/or a difference between the pulse width PW1 and the corresponding one of the pulse widths PW2 and PW3.

This configuration enables the pulse width of the secondary current I2 corresponding to each of the command values C1 to C3 to be reduced, making it possible to transfer a part of the energy application signal IGw, which includes information about the command values C1 to C3, to be faster than the above method of variably setting the pulse widths PW1 to PW3 based on the actual value of the corresponding one of the command values C1 to C3. It is possible to use any pulse width as the reference width for the pulses corresponding to the respective command values. It is also possible to use, each time of setting a present pulse width corresponding to a present command value, an immediately previous pulse width corresponding to an immediately previous command value as the reference width, thus sequentially updating the present pulse width relative to the reference pulse width each time of setting the present pulse width.

Each of the first to seventh embodiments is configured to, if one of the command-value number and the change-timing number is smaller than the other thereof, change the secondary current such that the other of the command-value number and the change-timing number is matched with one of the command-value number and the change-timing number. The present disclosure is however not limited to the configuration. Specifically, each of the first to seventh embodiments can be modified to, if one of the command-value number and the change-timing number is smaller than the other thereof, change the secondary current such that the shortage of one of the command-value number and the change-timing number is compensated for by a command value or a change timing. For example, if the change-value number is smaller than the command-value number, it is possible to compensate for the shortage of the change-value number using an additional reference change timing.

At least one of the controllers 70 and 70A to 70F is configured to instruct the controller 60 about the command values C2 and C3 and their change timings in accordance with the combustion state of the air-fuel mixture ignited by the spark plug 80; the combustion state of the air-fuel mixture is measured by at least one of the sensors 100. The present disclosure is however not limited to the above configuration. Specifically, at least one of the controllers 70 and 70A to 70F can be configured to instruct the controller 60 about the command values C2 and C3 and their change timings in accordance with command values C2 and C3 that are previously calibrated command values C2 and C3.

Each of the first to seventh embodiments is configured to set the three command values C1 to C3, but each of the fourth and seventh embodiments can be configured to only set the command value C1, and the other embodiments can be configured to set at least plural command values.

In particular, each of the fourth and seventh embodiments can be configured to set the level of the discharge control signal including the command value setting signal and the command value switching signal, which is output after completion of the output of the discharge start signal, in accordance with the command level C1. This enables the command level C1 for the discharge current to be included in the discharge control signal, which is output after completion of the output of the discharge start signal. That is, modulating, i.e. changing, the level of the discharge control signal enables the setting timing of the command value C1 to be instructed to the control circuit. This therefore enables the discharge current to be adjusted to the command level C1 at the setting timing of the command value C1 included in the discharge control signal. In addition, this configuration enables the command value C1 to be transferred to the control circuit after completion of the output of the discharge start signal, making it possible to instruct the control circuit about the command value C1 after the start of discharge.

The controller (70 or 70A to 70F) of each of the first to seventh embodiments is configured to modulate the command value setting signal, that is, the discharge control signal, such that the command value setting signal includes a pulse width or a signal level for each command value; the pulse width of signal level for each command value is set variably depending on the corresponding one of the command levels; the pulse width or signal level represents a value of a predetermined range defined for the corresponding command value In contrast, the controller (70 or 70A to 70F) of each of the first to seventh embodiments can be configured to modulate the command value setting signal, that is, the discharge control signal, such that the command value setting signal includes both a pulse width and a signal level that are set variably depending on each of the command levels; each of the pulse width and signal level represents a value of a predetermined range defined for the corresponding command value. For example, the controller (70 or 70A to 70F) of each of the first to seventh embodiments can be configured to modulate the command value setting signal, that is, the discharge control signal, such that the command value setting signal includes an integration area defined based on the level and width of a pulse for each of the command values; the integration area is set variably depending on the corresponding one of the command levels.

Figure 22:
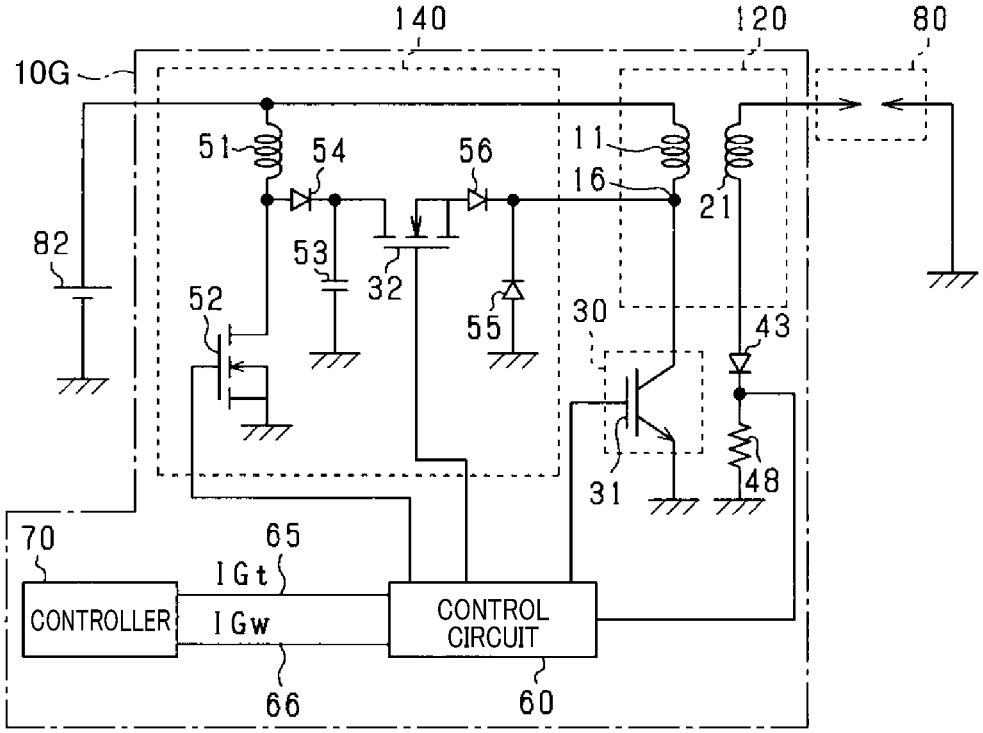
FIG. 22 is a block diagram schematically illustrating an example of the structure of an ignition apparatus according to another modification of the first embodiment of the present disclosure.

Referring to FIG. 22, an ignition apparatus 10G can include ignition coils 120 in place of the ignition coils 20, and an energy applying circuit 140 in place of the energy applying circuit 40. The following describes simply one ignition coil 120 provided for a corresponding spark plug 80.

The ignition coil 120 is designed as a commonly available ignition coil having no center tap.

The energy applying circuit 140 includes a choke coil 51, a switching element 52, a capacitor 53, and diodes 54 to 56.

The primary coil 11 has opposing first and second ends, the first end of the primary coil 11 is connected to the positive terminal of the battery 82, and the second end of the primary coil 11 is connected to the common signal ground via the switching element 31; the negative terminal of the battery 82 is connected to the common signal ground. The switching element 32 has opposing input and output terminals.

The second end of the primary coil 11 is connected to the output terminal of the switching element 32 via the diode 56. The anode of the diode 56 is connected to the output terminal of the switching element 32, and the cathode of the diode 56 is connected to the second end of the primary coil 11. A semiconductor switching element, such as a MOSFET, is preferably used as the switching element 32.

The input terminal of the switching element 32 is connected to the positive terminal of the battery 82 via the diode 54 and the choke coil 51. That is, the cathode of the diode 54 is connected to the input terminal of the switching element 32, and also is connected to the common signal ground via the capacitor 53. The anode of the diode 54 is connected to the choke coil 51 and the switching element 52.

The control circuit 60 is connected to the control terminal of the switching element 32, so that the control circuit 60 can control on-off switching operations of the switching element 32. These on-off switching operations of the switching element 32 under control of the controller 60 enable the primary coil 11 and the capacitor 53 to be connected or disconnected. The cathode of the flyback diode 55 is connected between the cathode of the diode 56 and the second end of the primary coil 11, and the anode of the flyback diode 55 is connected to the common signal ground.

The choke coil 51 has opposing first and second ends. The first end of the choke coil 51 is connected to the positive terminal of the battery 82, and the second end of the choke coil 51 is connected to the switching element 52. A semiconductor switching element, such as a MOSFET, is preferably used as the switching element 52.

The control circuit 60 is connected to the control terminal of the switching element 52, so that the control circuit 60 can control on-off switching operations of the switching element 52. These on-off switching operations of the switching element 52 under control of the controller 60 enable the current based on the battery 82 to be supplied to the choke coil 51 or to be shut off thereto. Controlling the on-off switching operations of the switching element 52 enables the capacitor 53 to be charged based on electrical energy stored in the choke coil 51. The diode 54 serves to prevent electrical energy stored in the capacitor 53 from flowing toward the choke coil 51.

Controlling the switching element 32 in the closed state, i.e. in the on state, enables the energy application circuit 140 to supply a boosted voltage, which is within the range from, for example, several tens of volts to several hundreds of volts, to the second end, which is connected to the common signal ground, of the primary coil 11. Note that the main ignition circuit 30 and the energy applying circuit 140 constitute an energization circuit for changing the energization state of the primary coil 11.

The ignition apparatus 10G set forth above obtains the identical benefits obtained by each of the first to seventh embodiments. Another energization circuit can be used for each of the ignition apparatuses 10 and 10A to 10F.

Each of the ignition apparatuses 10 and 10A to 10F is not limited to the structure illustrated in FIG. 1 or FIG. 22. Specifically, each of the ignition apparatuses 10 and 10A to 10F can be modified to have the following structure illustrated in FIG. 23 or FIG. 24.

Figure 23:
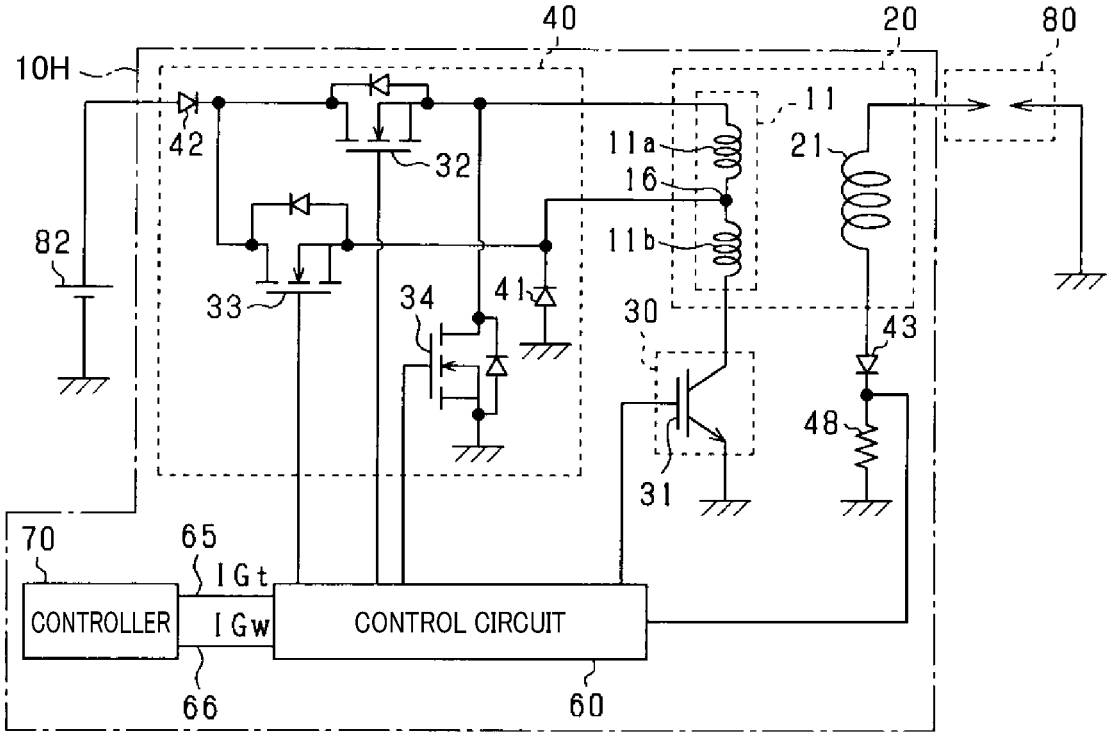
FIG. 23 is a block diagram schematically illustrating an example of the structure of an ignition apparatus according to a further modification of the first embodiment of the present disclosure.

Referring FIG. 23, in an ignition apparatus 10H, the first end of the first coil portion 11*a* is connected to the cathode of the diode 42 via the switching element 32, and anode of the diode 42 is connected to the positive terminal of the battery 82. The center tap 16 is connected to the cathode of the diode 42 via the switching element 33, and also connected to the cathode of the diode 41. Controlling the switching element 33 in the closed state, i.e. in the on state, enables the energy application circuit 40 to supply a voltage based on the battery 82 to the center tap 16 of the primary coil 11.

Figure 24:
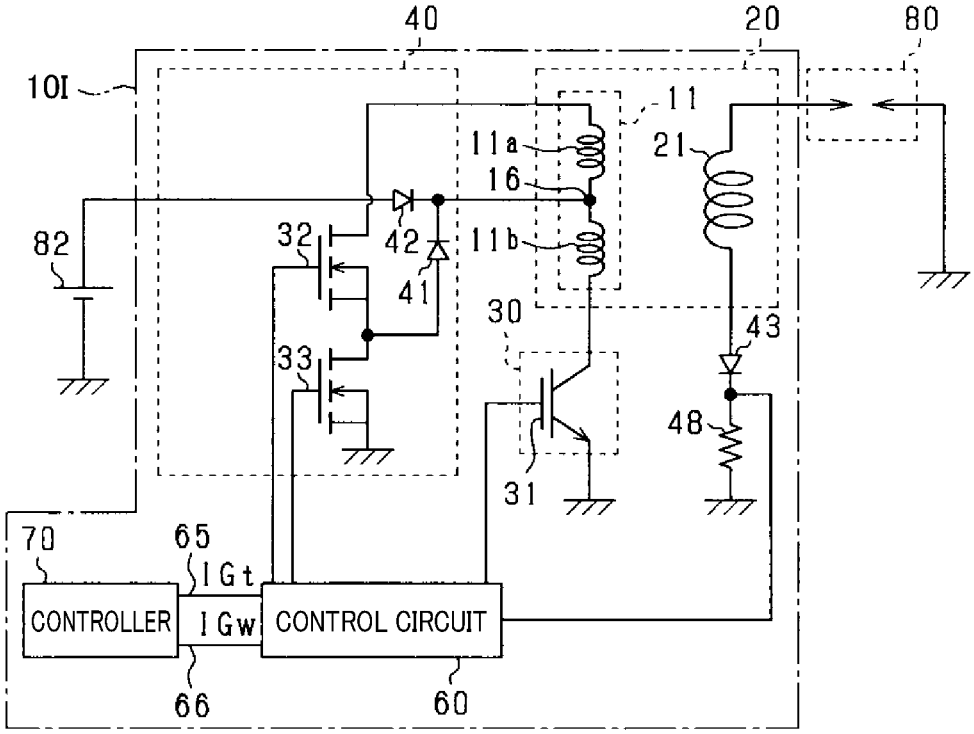
FIG. 24 is a block diagram schematically illustrating an example of the structure of an ignition apparatus according to a still further modification of the first embodiment of the present disclosure.

In addition, referring FIG. 24, in an ignition apparatus 10I, the first end of the first coil portion 11*a* is connected to a first end of the series-connected switching elements 32 and 33, and a second end of the series-connected switching elements 32 and 33, which is opposite to the first end is connected to the common signal ground. The center tap 16 is connected to the cathodes of both the diodes 41 and 42, and the anode of the diode 42 is connected to the positive terminal of the battery 82. The anode of the diode 41 is connected to a connection point between the series-connected switching elements 32 and 33.

That is, the controller 70 according to each of the ignition apparatuses 10H and 10I is configured to modulate the command value setting signal, that is, the discharge control signal, such that the command value setting signal includes a pulse width or a signal level for each command value; the pulse width of signal level for each command value is set variably depending on the corresponding one of the command levels; the pulse width or signal level represents a value of a predetermined range defined for the corresponding command value. Then, the control circuit 60 according to each of the ignition apparatuses 10H and 10I is configured to control, based on the discharge start signal and the discharge control signal, the energy applying circuit 40 to thereby change the discharge current to an instructed command value at a corresponding instructed change timing.

Each of the ignition apparatuses 10 and 10A to 10I is configured to superimpose an auxiliary secondary current in the superimposition discharge control on a main secondary current in the main discharge control, but the present disclosure is not limited thereto. If each of the ignition apparatuses 10 and 10A to 10I can be configured not to superimpose the auxiliary secondary current in the superimposition discharge control on the main secondary current in the main discharge control, the corresponding ignition apparatus is preferably designed to have a larger turn ratio of the ignition coil 20 and/or a higher voltage to be applied to the primary coil 11 in order to (1) Increase a secondary current to prevent interruption of the generated discharge, or (2) Restart a discharge based on energization of the primary coil 11 to cause a secondary current to flow again through the spark plug 80 even if the started discharge has been interrupted This may result in upsizing of the ignition coil or apparatus itself.

In contrast, each of the ignition apparatuses 10 and 10A to 10I, which is configured to superimpose an auxiliary secondary current in the superimposition discharge control on a main secondary current in the main discharge control, is capable of preventing the ignition coil 20 and apparatus itself from being upsized.

Each of the ignition apparatuses 10 and 10A to 10I is also capable of increasing the number of turns of at least one of the primary coil 11 and the secondary coil 21 to thereby increase the inductance of at least one of the primary coil 11 and the secondary coil 21. This makes it possible to increase the discharge time based on the main discharge control, thus superimposing the secondary current in the superimposition discharge mode on the main secondary current as long as possible. This enables a beginning value of the discharge start current based on the main discharge control to be reduced, thus preventing the wearing of the electrodes of the spark plug 80.

The signal control circuit 60*f* or 60*f*A to 60*f*F is configured to execute feedback control of on-off switching operations of the switching element 32 to thereby adjust the secondary current I2, which is measured based on the voltage across the current measurement resistor 48, to be within a predetermined range including a corresponding command value or a predetermined range including the corresponding command value at its lower limit. However, the signal control circuit 60*f* or 60*f*A to 60*f*F can be configured to execute feedforward control of on-off switching operations of the switching element 32 to thereby adjust the secondary current I2 to a corresponding command value.

The controller 70 or 70A to 70F is not limited to at least part of the engine ECU. At least part of a hybrid ECU for controlling an internal combustion engine and a motor, which serve as main engines of a vehicle, can be used as the controller 70 or 70A to 70F. At least part of a motor-generator (MG) ECU for controlling a motor-generator can be used as the controller 70 or 70A to 70F.

Each of the ignition apparatuses 10 and 10A to 10I can be applied to other types of spark-ignition engines, such as a spark-ignition engine using a mixed fuel or fuel other than gasoline.

While the illustrative embodiments of the present disclosure have been described herein, the present disclosure is not limited to the embodiments described herein, but includes any and all embodiments having modifications, omissions, combinations (e.g., of aspects across various embodiments), adaptations and/or alternations as would be appreciated by those having ordinary skill in the art based on the present disclosure. The limitations in the claims are to be interpreted broadly based on the language employed in the claims and not limited to examples described in the present specification or during the prosecution of the application, which examples are to be construed as non-exclusive.

What is claimed is:

1. An ignition apparatus for controlling a discharge current in a spark plug, the ignition apparatus comprising:

an ignition coil comprising a primary coil and a secondary coil connected to the spark plug;

an energization circuit configured to change an energization state of the primary coil;

a controller configured to output a discharge start signal instructing a start of a discharge in the spark plug, and a discharge control signal instructing control of a discharge current in the spark plug after the start of the discharge;

a control circuit; and a signal line connecting between the controller and the control circuit, the discharge start signal and the discharge control signal being transferred from the controller to the control circuit via the signal line, wherein:

the controller is configured to modulate, based on plural command values, the discharge control signal such that the modulated discharge control signal includes information representing the plural command values and change timings for the respective command values; and the control circuit is configured to control, based on the discharge start signal and the modified discharge control signal, the energization circuit to thereby adjust the discharge current to each of the command values at a corresponding one of the change timings.

2. The ignition apparatus according to claim 1, wherein:

the controller is configured to modulate, based on the plural command values, the discharge control signal such that the modulated discharge control signal includes, as the information, plural pulses, at least one of a signal level and a width of each of the pulses being set depending on a corresponding one of the command values.

3. The ignition apparatus according to claim 2, wherein:

the controller is configured to modulate, based on the plural command values, the discharge control signal such that the modulated discharge control signal includes:

a command value setting signal including the width of each of the pulses being set depending on the corresponding one of the command values, each of the pulses in the command value setting signal having a first signal level; and a command value switching signal including pulses whose signal levels represent the change timings of the respective command values, the signal level of each of the pulses included in the command value setting signal being different from the signal level of each of the pulses included in the command value switching signal, each of the pulses in the command value switching signal having a second signal level, one of the first and second signal levels being higher than a threshold signal level, the other of the first and second signal levels being lower than the threshold signal level; and the control circuit is configured to distinguish one of the command value setting signal and the command value switching signal from the other thereof in accordance with comparison between the threshold signal level and each of the first and second signal levels.

4. The ignition apparatus according to claim 1, wherein:

the controller is configured to output the modulated discharge control signal after completion of the output of the discharge start signal to the control circuit, so that each of the change timings is set after the completion of the output of the discharge start signal.

5. The ignition apparatus according to claim 1, wherein:

the controller is configured to modulate, based on the plural command values, the discharge control signal such that the modulated discharge control signal includes plural rising and/or falling timings, each of the rising and/or falling timings representing a corresponding one of the change timings.

6. The ignition apparatus according to claim 1, wherein:

the change timings are continuous change timings; and the controller is configured to modulate, based on the plural command values, the discharge control signal such that the modulated discharge control signal includes continuously changed signal levels based on the continuous change timings.

7. The ignition apparatus according to claim 1, wherein:

the signal line comprises a first signal line and a second signal line; and the controller is configured to output the discharge start signal to the control circuit via the first signal line.

8. The ignition apparatus according to claim 7, wherein:

the controller is configured to:

output the modulated discharge control signal to the control circuit via the second signal line;

modulate, based on the plural command values, a part of the discharge control signal such that the modulated part of the discharge control signal includes, as the information, the plural pulses, at least one of the signal level and the width of each of the pulses being set depending on a corresponding one of the command values; and output the modulated part of the discharge control signal to the control circuit while outputting the discharge start signal to the control circuit.

9. The ignition apparatus according to claim 7, wherein:

the controller is configured to:

set the discharge start signal to a high level in binary logical high and low levels when outputting the discharge start signal;

set the discharge start signal to the low level in the binary logical high and low levels when the output of the discharge start signal is completed;

modulate, based on the plural command values, a first part of the discharge control signal such that the first modulated part of the discharge control signal includes, as the information, the plural pulses, at least one of the signal level and the width of each of the pulses being set depending on a corresponding one of the command values;

modulate, based on the change timings for the respective plural command values, a second part of the discharge control signal such that the second modulated part of the discharge signal includes the change timings for the respective command values;

output the first modulated part of the discharge control signal to the control circuit while outputting the discharge start signal to the control circuit; and output the second modulated part of the discharge control signal to the control circuit after completion of the output of the discharge start signal; and the control circuit is configured to:

execute a first logical AND between the discharge start signal and the first modulated part of the discharge control signal to thereby extract the plural command values; and execute a second logical AND between an inversion of the discharge start signal and the second modulated part of the discharge control signal to thereby extract the change timings.

10. The ignition apparatus according to claim 7, wherein:

the plural command values comprise at least a first command value and a second command value;

the plural pulses comprise at least a first pulse and a second pulse corresponding to the at least first command value and second command value; and the controller is configured to:

output the modulated discharge control signal to the control circuit via the second signal line;

modulate a first part of the discharge control signal such that the modulated first part of the discharge control signal includes, as the information, the first pulse, at least one of the signal level and the width of the first pulse being set depending on the first command value;

modulate a second part of the discharge control signal such that the modulated second part of the discharge control signal includes, as the information, the second pulse, at least one of the signal level and the width of the second pulse being set depending on the second command value;

output the modulated first part of the discharge control signal to the control circuit while outputting the discharge start signal to the control circuit; and output the modulated second part of the discharge control signal to the control circuit after completion of the output of the discharge start signal.

11. The ignition apparatus according to claim 1, wherein:

the controller is configured to output the modulated discharge control signal after completion of the output of the discharge start signal to the control circuit, so that each of the change timings is set after the completion of the output of the discharge start signal; and the control circuit is configured to adjust, based on the discharge control signal, the discharge current to each of the command values at a corresponding one of the change timings.

12. The ignition apparatus according to claim 11, wherein:

the signal line comprises a single signal line connecting between the controller and the control circuit, the discharge start signal and the discharge control signal being transferred from the controller to the control circuit via the single signal line.

13. The ignition apparatus according to claim 1, wherein, when it is assumed that the number of the plural command values is referred to as a command-value number, and the number of the change timings is referred to as a change-timing number, the control circuit is configured to, upon determining that one of the command-value number and the change-timing number is smaller than the other thereof, adjust the discharge current such that the other of the command-value number and the change-timing number is matched with one of the command-value number and the change-timing number.

14. The ignition apparatus according to claim 1, wherein:

the controller is configured to modulate, based on the plural command values, the discharge control signal such that the modulated discharge control signal includes, as the information, plural pulses, at least one of a signal level and a width of each of the pulses being set relative to a reference value, the reference value being defined based on at least one of the command values.

15. An ignition apparatus for controlling a discharge current in a spark plug, the ignition apparatus comprising:

an ignition coil comprising a primary coil and a secondary coil connected to the spark plug;

an energization circuit configured to change an energization state of the primary coil;

a controller configured to output a discharge start signal instructing a start of a discharge in the spark plug, and a discharge control signal instructing control of a discharge current in the spark plug after the start of the discharge;

a control circuit;

a signal line connecting between the controller and the control circuit, the discharge start signal and the discharge control signal being transferred from the controller to the control circuit via the signal line, wherein:

the controller is configured to:

modulate, based on the plural command values, the discharge control signal such that the modulated discharge control signal includes information representing the plural command values and change timings for the respective command values; and output the modulated discharge control signal to the control circuit after completion of output of the discharge start signal to the control circuit; and the control circuit is configured to control, based on the discharge start signal and the modified discharge control signal, the energization circuit to thereby adjust the discharge current to each of the command values at a corresponding one of the change timings.

16. The ignition apparatus according to claim 15, wherein:

the energization circuit is configured to energize the primary coil in response to the discharge start signal to thereby cause a main secondary current to flow through the secondary coil, thus causing the main secondary current to flow in the spark plug as the discharge current; and the control circuit is configured to cause the energization circuit to superimpose an auxiliary secondary current having each of the command values on the main secondary current.

* * * * *